US009657734B2

(12) United States Patent
Holtzapple et al.

(10) Patent No.: US 9,657,734 B2
(45) Date of Patent: May 23, 2017

(54) GEROTOR WITH REDUCED LEAKAGE

(71) Applicant: StarRotor Corporation, College Station, TX (US)

(72) Inventors: Mark T. Holtzapple, College Station, TX (US); Jeffrey J. Breedlove, Grantham, NH (US); Daniel J. Micka, Enfield, NH (US)

( * ) Notice: Subject to any disclaimer, the term of this patent is extended or adjusted under 35 U.S.C. 154(b) by 97 days.

(21) Appl. No.: 14/622,705

(22) Filed: Feb. 13, 2015

(65) Prior Publication Data

US 2015/0267702 A1 Sep. 24, 2015

Related U.S. Application Data

(60) Provisional application No. 61/940,293, filed on Feb. 14, 2014.

(51) Int. Cl.

| | |
|---|---|
| ***F04C 18/10*** | (2006.01) |
| ***F04C 29/00*** | (2006.01) |
| ***F01C 19/02*** | (2006.01) |
| ***F04C 27/00*** | (2006.01) |
| ***F01C 1/10*** | (2006.01) |
| ***F01C 21/00*** | (2006.01) |
| ***F04C 29/12*** | (2006.01) |

(52) U.S. Cl.

CPC ..... *F04C 18/10* (2013.01); *F01C 1/10* (2013.01); *F01C 1/103* (2013.01); *F01C 19/02* (2013.01); *F01C 19/025* (2013.01); *F01C 21/005* (2013.01); *F04C 27/001* (2013.01); *F04C 27/004* (2013.01); *F04C 29/0028* (2013.01); *F04C 29/12* (2013.01); *F04C 29/0035* (2013.01); *F04C 2230/91* (2013.01); *F04C 2240/805* (2013.01); *F04C 2250/10* (2013.01); *F04C 2250/101* (2013.01); *F04C 2250/102* (2013.01); *F04C 2250/20* (2013.01)

(58) Field of Classification Search

CPC ..... F04C 27/004; F04C 27/001–27/003; F04C 27/00; F04C 29/0028; F04C 18/10–18/113; F04C 2230/91; F04C 15/0019; F04C 15/0046; F04C 15/0007–15/0015; F04C 15/0003; F04C 2/10–2/113; F04C 27/008; F01C 1/10; F01C 1/103; F01C 19/02; F01C 19/025; F01C 21/005

See application file for complete search history.

(56) References Cited

U.S. PATENT DOCUMENTS

| | | | | | |
|---|---|---|---|---|---|
| 3,779,674 | A * | 12/1973 | Eckerle | F04C 2/101 | 418/102 |
| 4,846,642 | A * | 7/1989 | Nuber | F01C 19/005 | 418/151 |
| 7,695,260 | B2 * | 4/2010 | Holtzapple | F01C 1/103 | 418/104 |
| 2002/0187051 | A1 * | 12/2002 | Maier | F04C 11/005 | 417/203 |

(Continued)

*Primary Examiner* — Thai Ba Trieu
*Assistant Examiner* — Xiaoting Hu

(57) ABSTRACT

A system and method are presented for improved performance of gerotor compressors and expanders. Certain aspects of the disclosure reduce porting losses in a gerotor system. Other aspects of the disclosure provide for reduced deflection in lobes of an outer rotor of a gerotor system. Still other aspects of the disclosure provide for reduced leakage through tight gaps between components of a gerotor system.

3 Claims, 20 Drawing Sheets

(56) References Cited

U.S. PATENT DOCUMENTS

| | | | | |
|---|---|---|---|---|
| 2008/0219873 | A1* | 9/2008 | Nishikata | F01C 21/0809 418/77 |
| 2009/0220369 | A1* | 9/2009 | Wiedenhoefer | F04C 2/1071 418/48 |
| 2010/0003152 | A1* | 1/2010 | Holtzapple | F01C 1/104 418/61.3 |

* cited by examiner

GEROTOR WITH REDUCED LEAKAGE

CROSS-REFERENCE TO RELATED APPLICATIONS

The present application is related to U.S. Provisional Patent Application No. 61/940,293, which was filed on Feb. 14, 2014, and is entitled "Features that Improve the Performance of Gerotor Compressors and Expanders." Provisional Patent No. 61/940,293 is hereby incorporated by reference into the present application as if fully set forth herein. The present application hereby claims priority under 35 U.S.C. §119(e) to U.S. Provisional Patent No. 61/940,293.

TECHNICAL FIELD

The present disclosure is directed, in general, to gerotor compressors and expanders, and more specifically, to features that improve the performance of gerotor compressors and expanders.

BACKGROUND

A gerotor operates using inner and outer rotors that rotate about their respective axes within a housing. A drive mechanism synchronizes the rotors so that they do not touch. As the rotors rotate, teeth of the inner rotor and lobes of the outer rotor move relative to each other to create voids between the teeth of the inner rotor and the lobes of the outer rotor that open, reach a maximum volume, and then close. Fluid enters and leaves the voids through gaps (referred to as ports) between the lobes of the outer rotor.

The housing comprises four regions. A first of the four regions forms an inlet duct for the gerotor system. A second of the four regions forms an outlet duct for the gerotor system. The third and fourth of the four regions are located between the inlet duct region and the outlet duct region and have small clearances between inner and outer rotors and the housing. These two regions operate to prevent fluid flow around the outside of the outer rotor between the inlet duct and the outlet duct.

For a gerotor system operating as a compressor, input power to the drive mechanism drives the rotors. A fluid enters from the inlet duct of the housing through one or more intake ports as the void opens. Once the fluid is captured, the void volume decreases, causing the pressure of the fluid to increase. After a desired pressure (generated by the geometries of the two rotors) is achieved, the fluid exits through one or more outlet ports into the outlet duct of the housing.

For a gerotor system operating as an expander, high-pressure fluid enters from the inlet duct of the housing through one or more intake ports into a small void in the gerotor. The fluid is captured, and the fluid pressure operates on the rotors to cause the void volume to increase as the fluid pressure decreases. The expanding fluid causes the rotors to turn. After a desired pressure is achieved, the fluid exits through one or more outlet ports into the outlet duct of the housing. The rotation of the rotors produces output power from the gerotor drive mechanism.

Gerotor compressors and expanders have several advantages that apply to both gerotor compressors and expanders, such as the following:

No valves;
Low vibration;
Compact;
Efficient;
Tolerant of liquid;

Low manufacturing cost;
High pressure ratio per stage;
Rotational speed matches conventional engines, motors, and generators;
Low parts count;
Oil-free operation; and
Operates efficiently at varying speeds

SUMMARY OF THE DISCLOSURE

According to a first embodiment of the present disclosure, a gerotor system includes an inner rotor, an outer rotor having a plurality of ports, and a housing. The plurality of ports includes an inlet subset of ports and an outlet subset of ports. Fluid flows into the gerotor system through the inlet subset of ports and out of the gerotor system through the outlet subset of ports. The housing includes an inlet duct fluidly coupled with the inlet subset of ports and an outlet duct fluidly coupled with the outlet subset of ports. The inlet duct includes an input pipe and the outlet duct includes an outlet pipe. The inlet pipe is located on the inlet duct based upon a location of an inlet port in the inlet subset of ports having a highest inlet fluid velocity through the inlet port. The outlet pipe is located on the outlet duct based upon a location of an outlet port in the outlet subset of ports having a highest outlet fluid velocity through the outlet port.

According to a second embodiment of the present disclosure, a gerotor system includes an inner rotor, an outer rotor having a plurality of ports, and a housing. The plurality of ports includes an inlet subset of ports and an outlet subset of ports. Fluid flows into the gerotor system through the inlet subset of ports and out of the gerotor system through the outlet subset of ports. The housing further includes an inlet duct fluidly coupled with the inlet subset of ports and an outlet duct fluidly coupled with the outlet subset of ports.

The inlet duct includes a plurality of inlet channel vanes that extend from an entrance end to a rotor end of the inlet duct. The inlet channel vanes form a plurality of inlet channels, which alter substantially identical velocities of fluid entering the inlet channels to a velocity at the rotor end that substantially matches a velocity of fluid through one or more corresponding inlet ports.

The outlet duct includes a plurality of outlet channel vanes extending from a rotor end to an exit end of the outlet duct. The outlet channel vanes form a plurality of outlet channels, each outlet channel configured to alter a velocity of fluid at the rotor end of the outlet channel that is determined by a velocity of fluid through one or more corresponding outlet ports to substantially identical velocities of fluid exiting the outlet channels.

According to a third embodiment of the present disclosure, a gerotor system includes an inner rotor, an outer rotor having a plurality of ports, and a housing. The plurality of ports includes an inlet subset of ports and an outlet subset of ports. Fluid flows into the gerotor system through the inlet subset of ports and out of the gerotor system through the outlet subset of ports. The housing further includes an inlet duct fluidly coupled with the inlet subset of ports and an outlet duct fluidly coupled with the outlet subset of ports. The inlet duct includes an input pipe located at a first end of the inlet duct and the outlet duct includes an outlet pipe located at a first end of the outlet duct. A profile of a circumferential portion of the inlet duct varies from the first end to a second end of the inlet duct to alter fluid velocity vectors in the inlet duct to more closely match fluid velocity vectors passing through corresponding inlet ports. A profile of a circumferential portion of the outlet duct varies from the first end to a second end of the outlet duct to alter fluid velocity vectors passing through one or more outlet ports to substantially the same fluid velocity in the outlet pipe.

According to a fourth embodiment of the present disclosure, a gerotor system includes an inner rotor, an outer rotor having a plurality of ports, and a housing. The outer rotor includes a plurality of lobe portions and at least one disk portion. The outer rotor further includes a feature on an inner surface of the outer rotor, where the feature is configured to reduce stress concentration in the bases of the lobe portions.

According to a fifth embodiment of the present disclosure, a gerotor system includes an inner rotor, an outer rotor having a plurality of ports, and a housing. The outer rotor includes a plurality of lobe components and a plurality of disk components. Each lobe component is mounted to the disk components by at least one pin passing through at least one disk component into the lobe component.

According to a sixth embodiment of the present disclosure, a gerotor system includes an inner rotor, an outer rotor having a plurality of ports, and a housing. The outer rotor includes a plurality of lobe components and a plurality of disk components, wherein the lobe components are hollow.

According to a seventh embodiment of the present disclosure, a gerotor system includes an inner rotor, an outer rotor having a plurality of ports, and a housing. The outer rotor includes a plurality of lobe components and a plurality of disk components. An outer portion of each lobe component includes a first material and an inner portion of each lobe component includes a second material. The second material is a lighter material than the first material.

According to an eighth embodiment of the present disclosure, a gerotor system includes an inner rotor, an outer rotor having a plurality of ports, and a housing. The outer rotor includes an outer surface having a region in proximity to a corresponding region of an inner surface of the housing. Either the outer rotor region or the housing region includes a labyrinth seal that is configured to reduce fluid leakage through a gap between the outer rotor region and the housing region.

According to a ninth embodiment of the present disclosure, a gerotor system includes an inner rotor, an outer rotor having a plurality of ports, and a housing. The inner rotor includes an outer face in proximity to a corresponding inner face of the housing. Either the inner rotor face or the housing face includes a labyrinth seal that is configured to reduce fluid leakage through a gap between the inner rotor face and the housing face.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

It should be understood at the outset that, although example embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

For simplicity, this disclosure will focus on compressors; however, it should be understood that the disclosure applies equally as well to expanders. Further, it should be understood that a compressor and expander may be combined to form an engine, so the discussions below apply to engines as well.

While this disclosure discusses fluid flow into, within, and out of gerotors according to the disclosure, it will be understood that such fluids may comprise vapor or gas or a mixture of gas and fluid. Indeed, in gerotor operating as a compressor, a gas may enter the gerotor and be liquefied through compression.

The performance of gerotor compressors can be enhanced by incorporating features that accomplish the following:

reduce porting losses;

cut abradable coatings;

reduce deflection of outer-rotor lobes; and reduce leakage through tight gaps.

Each feature will be discussed in more detail.

Reduce Porting Losses

In gerotor compressors, fluid enters through ports during an intake portion of a cycle and exits through other ports during a discharge portion of the cycle. Compared to the size of the ducts that carry fluid to and from the compressors, the size of the ports is relatively small; therefore, the fluid must accelerate to flow through the ports. The acceleration and subsequent deceleration may cause turbulence near the ports, which can reduce efficiency. Incorporating features that reduce turbulence can reduce porting losses.

Figure 1:
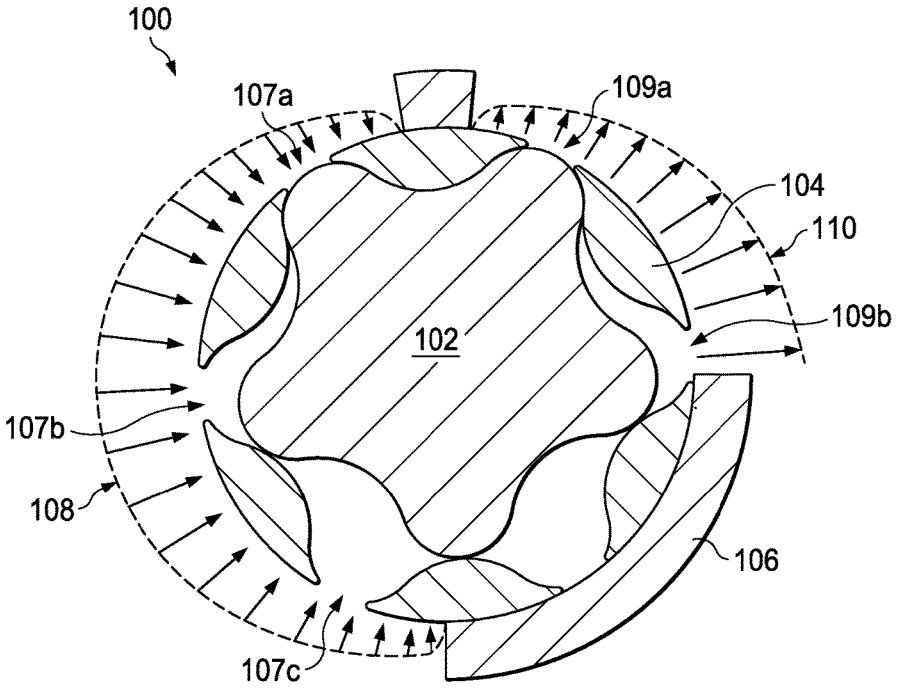
FIG. 1 shows radial velocity vectors through ports at an inlet and an outlet of a gerotor compressor.

FIG. 1 shows radial velocity vectors through ports at an inlet and an outlet of a gerotor compressor 100. FIG. 1 presents a cutaway view of the compressor 100. The compressor 100 includes an inner rotor 102, an outer rotor 104 and a housing 106. Radial velocity vectors 108 indicate fluid velocity through inlet ports 107*a*, 107*b*, and 107*c* of the outer rotor 104. Radial velocity vectors 110 indicate fluid velocity through outlet ports 109*a* and 109*b* of the outer rotor 104.

The radial velocity vectors 108 and 110 through the ports are directly related to the rate of change of the rotating void volume. It should be noted that in addition to the radial velocity vector, there is also a circumferential velocity vector (not shown) that results from the rotation of the rotors. The circumferential velocity vector depends upon rotation rate of the inner rotor and outer rotor.

At the compressor inlet, the volume change is small at the 7 and 11 o'clock positions and is largest at the 9 o'clock position. The actual lengths of the radial velocity vectors shown in FIG. 1 depends on the specific geometry of the rotors; here, the vectors are illustrative and not quantitative.

At the compressor outlet, the volume change is small at the 1 o'clock position and is largest at the 3 o'clock position. The actual lengths of the radial velocity vectors shown in FIG. 1 depends on the specific geometry of the rotors; here, the vectors are illustrative and not quantitative.

FIG. 1 is also representative of the radial velocity vectors for an expander; however, for an expander the direction of the arrows would be reversed.

To improve efficiency, fluid velocity through a port should more closely match the velocity in a duct external to the port. When there is a mismatch in fluid velocities, turbulence is generated, which converts kinetic energy into thermal energy and reduces efficiency. In addition, efficiency is improved when the direction of the velocity through the port matches that through ducts carrying fluid to or from the gerotor. The flow through a duct may be substantially radial; however, it should be noted that there is a circumferential component to the velocity vector, which reflects that fact that the inner rotor and outer rotor are rotating.

Figure 2A:
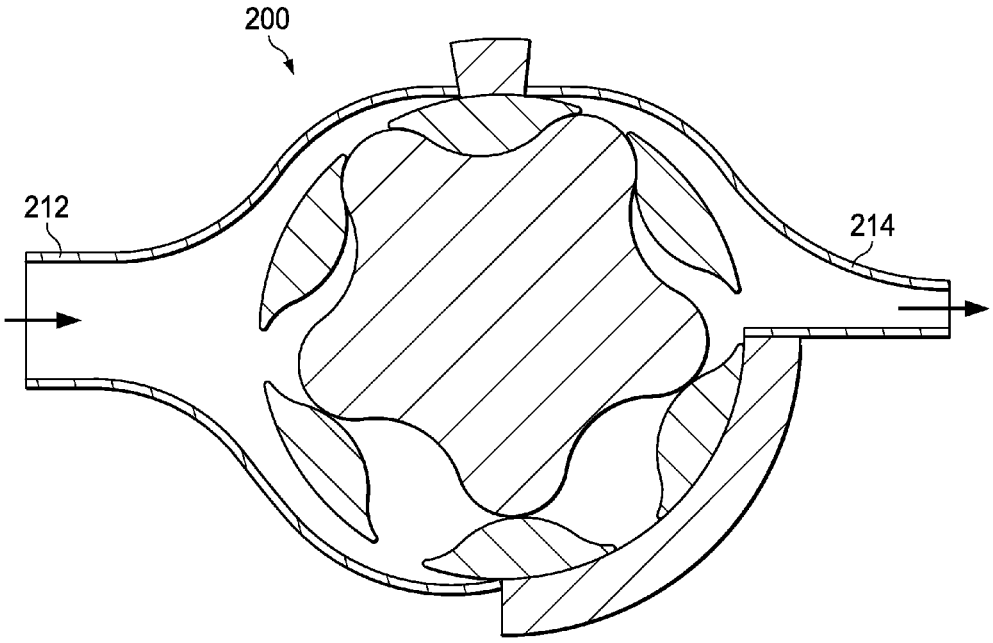
FIGS. 2A and 2B show ducting geometries according to the disclosure that reduce mismatches in fluid velocities and directions for a compressor having a low rotation rate (FIG. 2A) and a compressor having a high rotation rate (FIG. 2B)
Figure 2B:
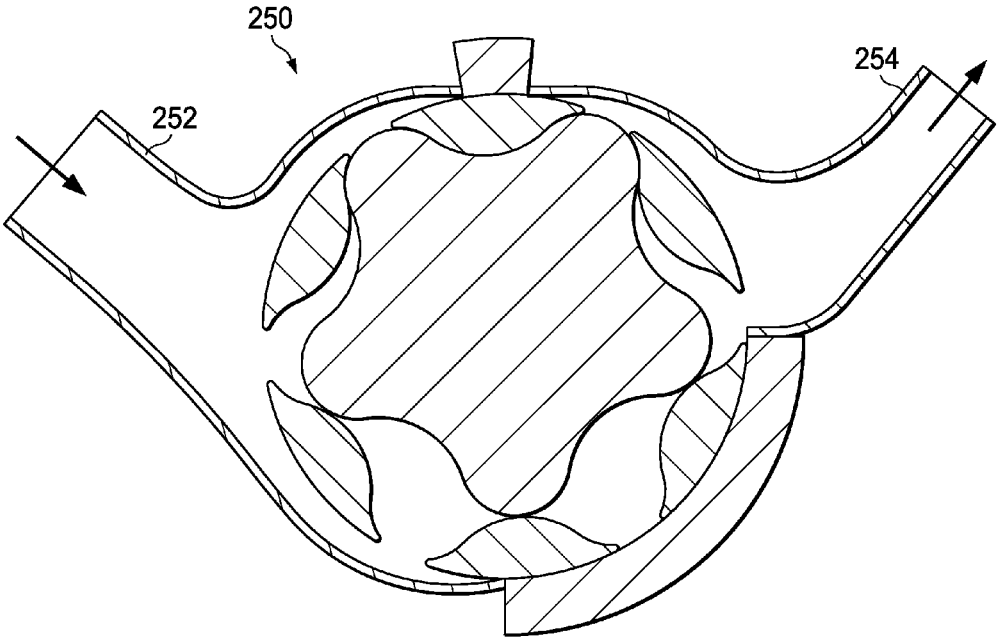

FIG. 2 shows ducting geometries according to the disclosure that reduce mismatches in fluid velocities and directions for a compressor 200 having a low rotation rate (FIG. 2*a*) and a compressor 250 having a high rotation rate (FIG. 2*b*). The compressor 200 of FIG. 2*a* includes an inlet duct 212 and an outlet duct 214. The compressor 250 of FIG. 2*b* includes an inlet duct 252 and an outlet duct 254.

Because the port velocities are highest in the 3 and 9 o'clock positions, the compressor outlet and inlet pipes are located generally at the 3 and 9 o'clock positions, respectively. It should be noted that for a compressor having a compression ratio higher than the compressors shown in FIG. 2, a trailing edge of a circumferential seal between the outer rotor and the housing would be placed in a more advanced position, for example the 2 o'clock position. In such an embodiment, the compressor outlet pipe would move to the 2 o'clock position so as to match the position with the greatest flow. On the other hand, for a compressor have a compression ratio less than the compressors shown in FIG. 2, the trailing edge of the circumferential seal would move to a less advanced position, for example the 4 o'clock position. In such an embodiment, the compressor outlet pipe would stay in the 3 o'clock position so as to match the position with the greatest flow.

To reduce losses, it is desirable that fluid direction in a duct more closely match a direction of fluid flow through the port. To satisfy this condition, an axis of the inlet and outlet pipes may be substantially aligned with dominant velocity vectors emanating from the outer rotor. As noted previously, the velocity vectors through the ports are not purely radial and have a circumferential component that results from rotor rotation. To improve efficiency, the axis of the inlet and outlet pipes may be aligned with the dominant velocity vectors through the ports, which includes both a radial and circumferential component. FIG. 2 shows two cases. FIG. 2*a* shows desirable axes of inlet pipe 212 and outlet pipe 214 for a gerotor 200 that rotates slowly. FIG. 2*b* shows desirable axes of inlet pipe 252 and outlet pipe 254 for a gerotor 250 that rotates rapidly.

To service the entire circumference of the fluid inlet, an inlet duct should extend from the 6 to the 12 o'clock positions. As a result, some of the fluid entering the compressor must flow in the circumferential direction. The gap between the outer rotor and the duct is defined by ensuring that at any angular position, the velocity of the fluid through the port (as illustrated in FIG. 1) matches the velocity in the circumferential direction. Similar considerations are employed when specifying the gap for the compressor outlet.

Although FIG. 2 only shows two cases, in other configurations, the inlet pipe and outlet pipe in particular configurations may be movable to compensate for dynamic variations within the gerotor. As a non-limiting example, for certain rotation speeds, a first direction may be set for the inlet and/or outlet. For other rotations speeds, a second direction may be utilized for the inlet and/or outlet. Any suitable device may be used to dynamically change the direction of the inlet/outlet including, but not limited to, inlet/outlet pipes connected to a crank. In certain configurations, one or more sensors may detect changing conditions (e.g., dominant velocity, increased rotational speed, and/or flow rate) and automatically change the direction of the inlet and/or outlet pipe to maximize the efficiency.

Figure 3:
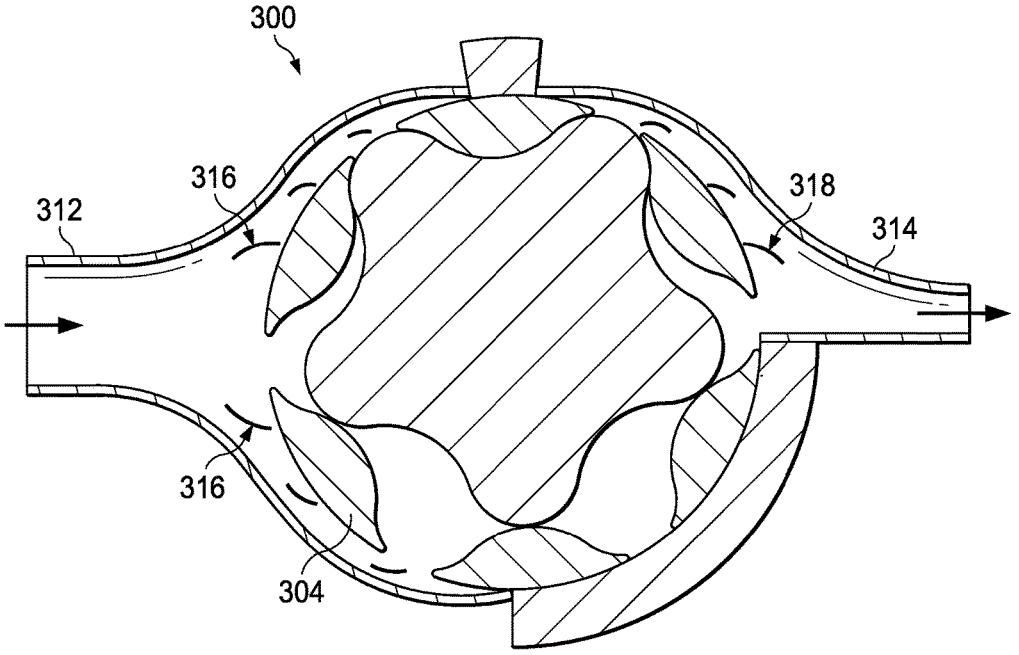
FIG. 3 shows turning vanes according to the disclosure added to ducts to help turn fluid circumferential flow to and from radial flow, in order to enter and exit ports, respectively.

FIG. 3 shows turning vanes 316 according to the disclosure that are added to ducts to help turn fluid circumferential flow to and from radial flow, in order to enter and exit ports, respectively. A gerotor system 300 includes an outer rotor 304, an inlet duct 312 having turning vanes 316, and an outlet duct 314 having turning vanes 318. As noted previously, the fluid flow through ports of the outer rotor 304 is not purely radial and has a circumferential component. Profiles of turning vanes 316 are designed to alter radial and circumferential velocity vector components of fluid in regions of the inlet duct 312 to more closely match fluid velocity vectors passing into corresponding ones of the inlet ports of the outer rotor 304. Profiles of turning vanes 318 are designed to alter radial and circumferential velocity vector components of fluid passing through outlet ports in the outer rotor 304 to more closely match fluid velocity vectors in corresponding regions of the outlet duct 314.

Similar to the inlet and outlet pipes described with reference to FIGS. 2*a* and 2*b*, the turning vanes in particular configurations may also be designed to dynamically move based on changing conditions of the fluid flow through the gerotor system. In other configurations, the turning vanes may be fixed.

Figure 4:
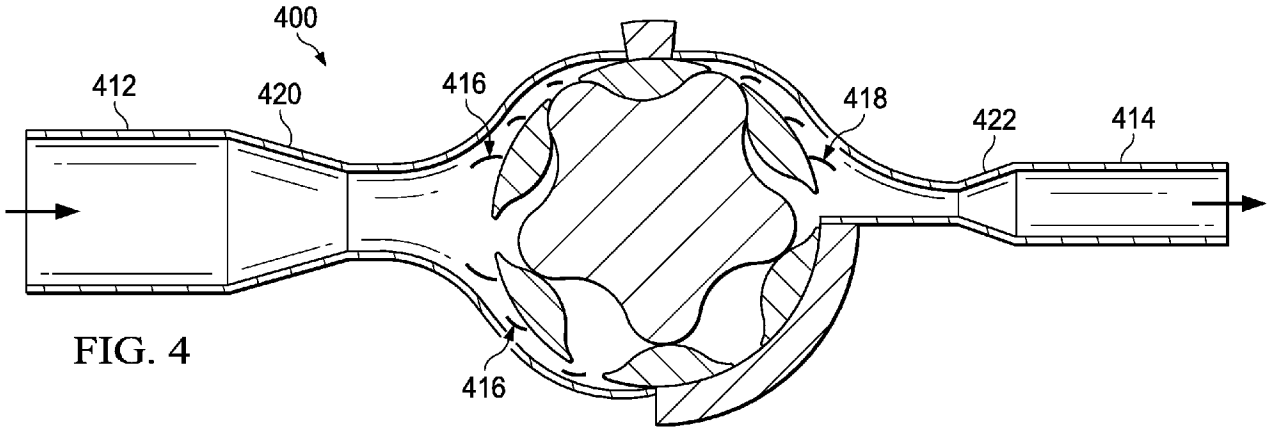
FIG. 4 shows a gerotor system according to the disclosure having a converging section in an inlet pipe and a diverging section in an outlet pipe.

FIG. 4 shows a gerotor system 400 according to the disclosure having a converging section 420 added to inlet pipe 412. The converging section 420 pre-accelerates fluid flow to velocities that match the port velocities. The gerotor system 400 also includes a diverging section 422 in outlet pipe 414. The diverging section 422 decelerates fluid flow to match a final fluid velocity exiting the system 400. The system 400 also includes turning vanes 416 and 418, however, it will be understood that other embodiments may not include turning vanes.

Figure 5:
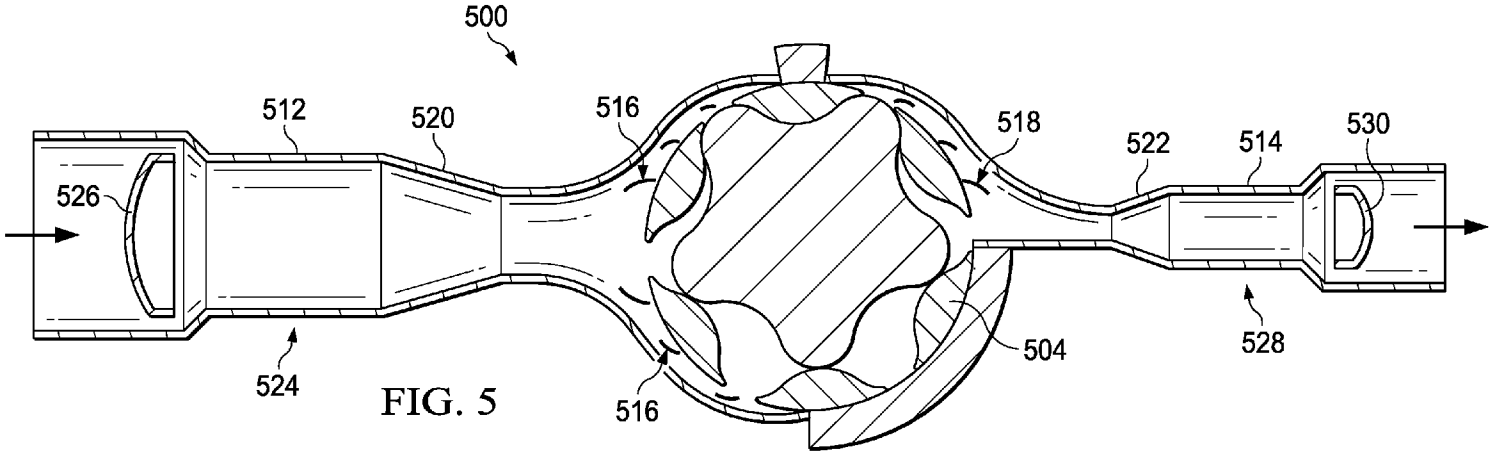
FIG. 5 shows a gerotor system according to the disclosure having "tuning" sections in each of an inlet duct and an outlet duct.

Typically, fluid flow entering and exiting the compressor is not completely smooth and has pulses. The pulse frequency is N times the rotational rate of the outer rotor, where N is the number of ports in the outer rotor. FIG. 5 shows a gerotor system 500 according to the disclosure, having a "tuning" section 524 in the inlet duct 512 and a tuning section 528 in the outlet duct 514. The lengths of the tuning sections 524 and 528 are adjusted so that the resonant frequencies of the tuning sections 524 and 528 match the pulse frequency related to the pulse frequency of outer rotor 504. The resonant frequencies in the tuning sections 524 and 528 are also dependent upon the mass of the fluid in the inlet duct 512 and the outlet duct 514.

There are many ways to construct a resonant tuning section according to the disclosure. FIG. 5 shows an embodiment in which an end cap 526, which is mechanically fixed in a larger section of the inlet duct 512, defines a length of the tuning section 524. Similarly, an end cap 530 that is mechanically fixed in a larger section of the outlet duct 514 and defines a length of the tuning section 528.

The gerotor system 500 includes a converging section 520 and turning vanes 516. Additionally, the system 500 includes a diverging section 522 and turning vanes 518.

Figure 6:
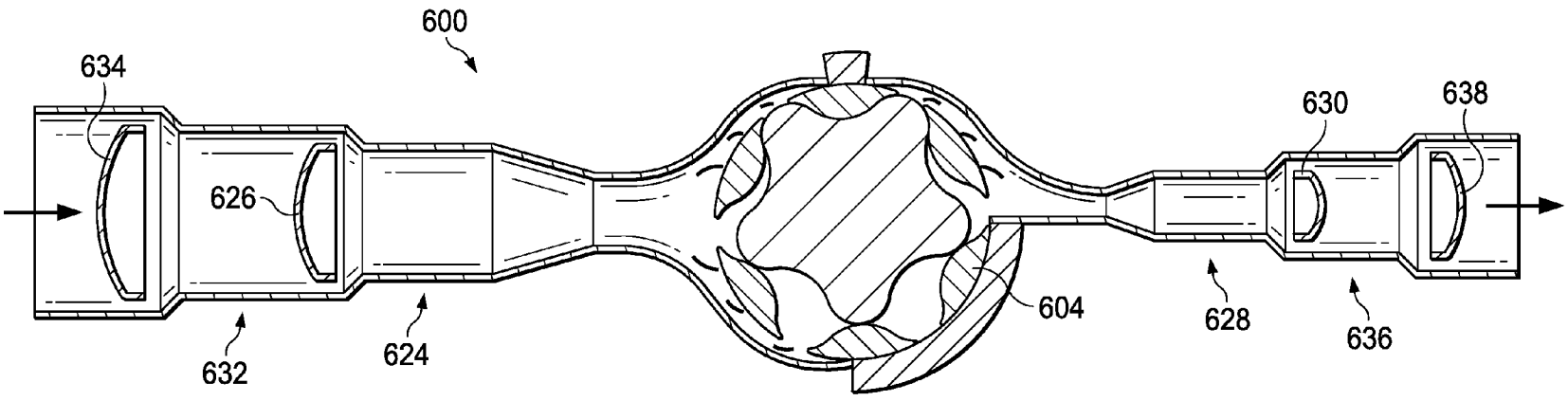
FIG. 6 shows a gerotor system according to the disclosure having two tuning sections in each of an inlet duct and an outlet duct.

FIG. 6 shows a gerotor system 600 according to the disclosure having two tuning sections in each of the inlet and outlet ducts. The gerotor system 600 includes a first input tuning section 624, defined by an end cap 626. The system 600 also includes a second input tuning section 632, defined by an end cap 634. Additionally, the system 600 includes a first outlet tuning section 628, defined by an end cap 630, and a second outlet tuning section 636, defined by an end cap 638.

Figure 7:
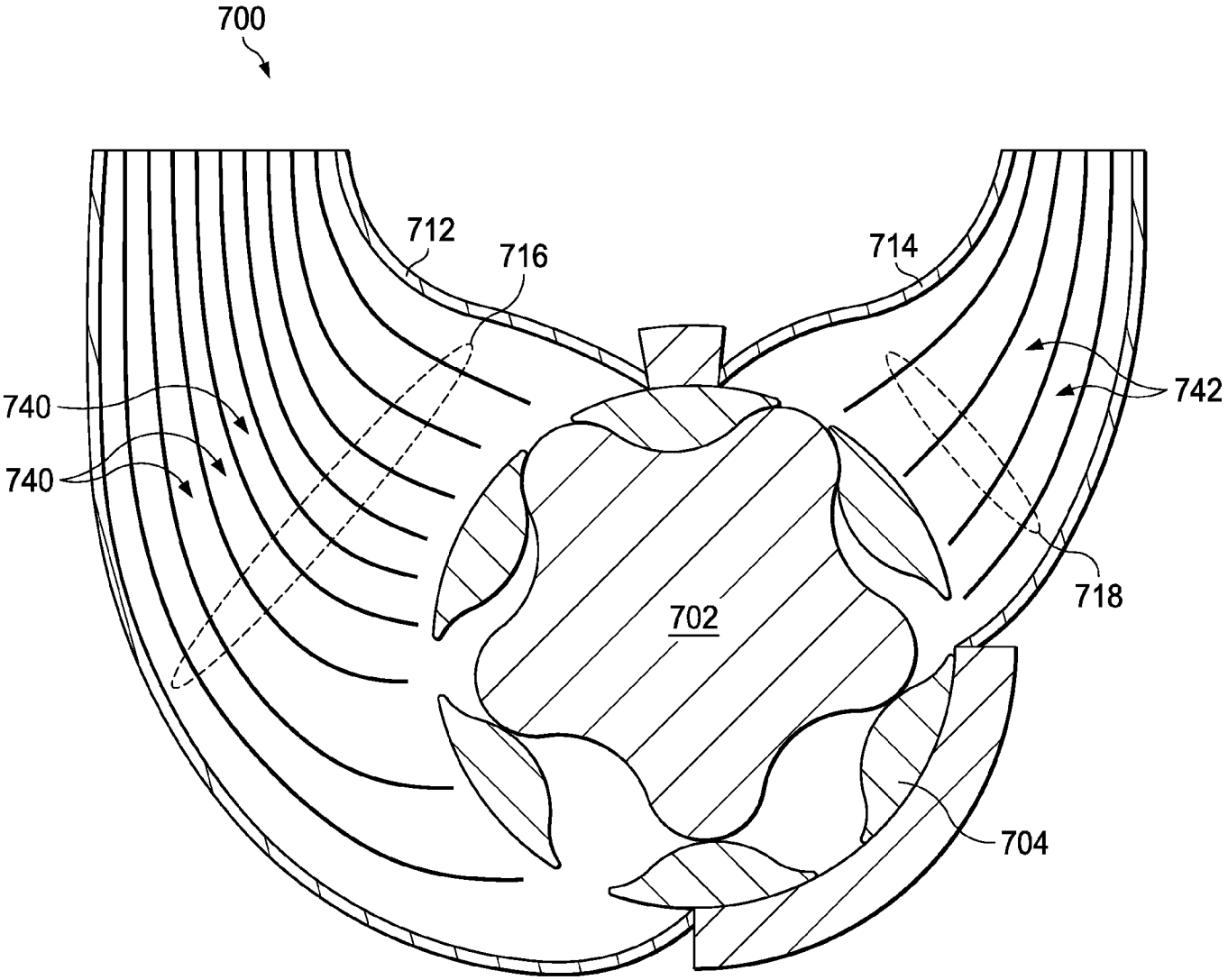
FIG. 7 shows an alternative duct geometry according to the disclosure that incorporates numerous channels that segment fluid flow.

FIG. 7 shows an alternative duct geometry according to the disclosure that incorporates numerous channels that segment the flow. A gerotor system 700 includes an inlet duct 712 and an outlet duct 714. The inlet duct 712 includes inlet channel vanes 716 extending from an entrance end of the inlet duct 712 to a rotor end of the inlet duct 712. The inlet channel vanes 716 form inlet channels (indicated generally as 740) between adjacent inlet channel vanes 716, as well as between the walls of the inlet duct 712 and the outermost inlet channel vanes 716. Similarly, the outlet duct 714 includes outlet channel vanes 718 extending from a rotor end of the outlet duct 714 to an exit end of the outlet duct 714. The outlet channel vanes 718 form outlet channels (indicated generally as 742) between the adjacent outlet channel vanes 718, as well as between the walls of the outlet duct 714 and the outermost outlet channel vanes 718. Each inlet channel 740 and each outlet channel 742 has a profile, defining a width of the channel.

The inlet channels 740 and the outlet channels 742 are designed with the following considerations. At the entrance to the inlet duct 712, all fluid velocity vectors into the inlet duct 712 are substantially identical. As fluid flows along the inlet channels 740, the widths of the channels change so that, at the rotor end of the channels, magnitudes of the fluid velocities in the inlet channels 740 substantially match magnitudes of the fluid velocity through corresponding ports of outer rotor 704 (as explained above with reference to FIG. 1). Similarly, fluid flowing out of the outer rotor 704 has differing velocities, depending upon a current position of a port of the outer rotor 704 through which the fluid is flowing. As fluid flows along the outlet channels 742, the widths of the channels change so that, at the exit end of the outlet duct 714, magnitudes of the fluid velocities in each channel are substantially identical.

Additionally, angles of the channels 740 in the inlet duct 712 vary so as to introduce circumferential components in the velocity of the incoming fluid that accommodate a rotational speed of the rotor 702 (as discussed with reference to FIGS. 2 and 3). Similarly, angles of the channels 742 in the outlet duct 714 vary so as to remove circumferential components in the velocity of the fluid exiting the outlet duct 714.

Figure 8A:
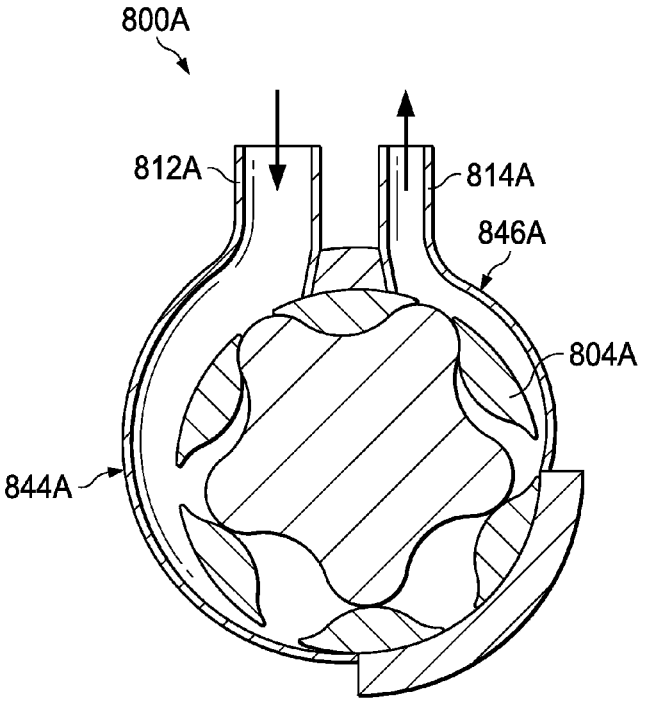
FIGS. 8A and 8B show circumferential ducting according to the disclosure with varying cross-sectional area for a gerotor compressor (FIG. 8A) and a gerotor expander (FIG. 8B)
Figure 8B:
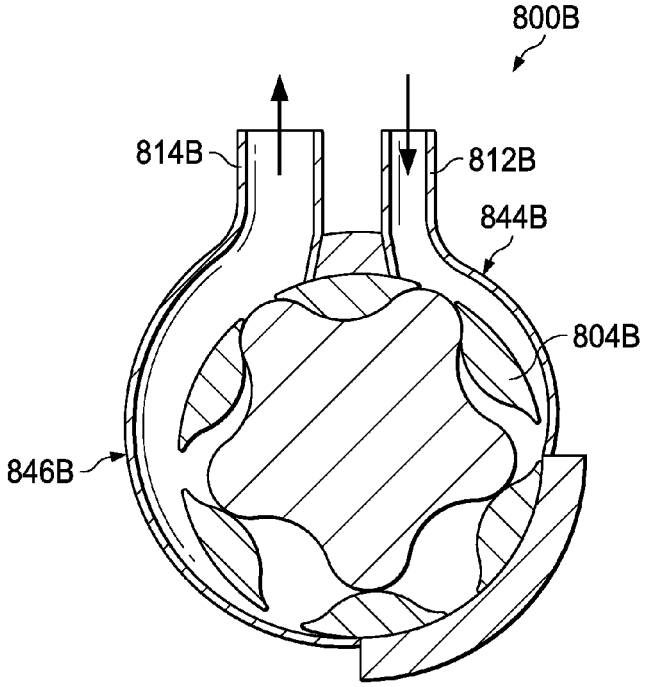

FIGS. 8A and 8B show circumferential ducting according to the disclosure with varying cross-sectional area. FIG. 8A depicts a gerotor compressor 800A having an inlet duct

812A and an outlet duct 814A. A profile of a circumferential portion 844A of the inlet duct 812A is varied so that a velocity of incoming fluid in the inlet duct 812A is varied by differing amounts in the circumferential portion 844A to substantially match the velocities through the inlet ports of an outer rotor 804A, as described above with reference to FIG. 1. Similarly, a profile of a circumferential portion 846A of the outlet duct 814A is varied so that the differing velocities of outgoing fluid at the outlet ports of the outer rotor 804A are reduced by corresponding amounts to substantially the same velocity in the outlet duct 814A.

FIG. 8B depicts a gerotor expander 800B having an inlet duct 812B and an outlet duct 814B. A profile of a circumferential portion 844B of the inlet duct 812B is varied so that a velocity of incoming fluid in the inlet duct 812B is varied by differing amounts in the circumferential portion 844B to substantially match the velocities through the inlet ports of an outer rotor 804B. Similarly, a profile of a circumferential portion 846B of the outlet duct 814B is varied so that the differing velocities of outgoing fluid at the outlet ports of the outer rotor 804B are reduced by corresponding amounts to substantially the same velocity in the outlet duct 814B.

Figure 9A:
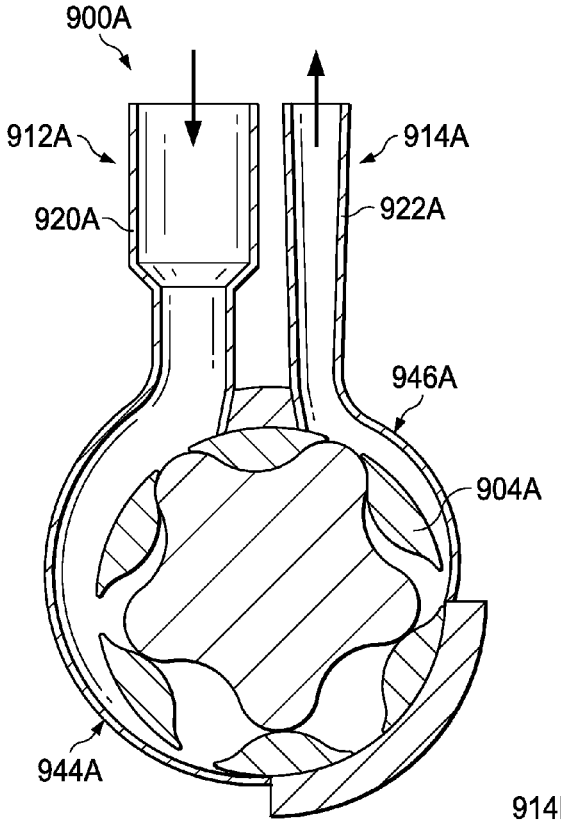
FIGS. 9A and 9B show circumferential ducting according to the disclosure having a converging section in an inlet duct and a diverging section in an outlet duct for a gerotor compressor (FIG. 9A) and a gerotor expander (FIG. 9B)
Figure 9B:
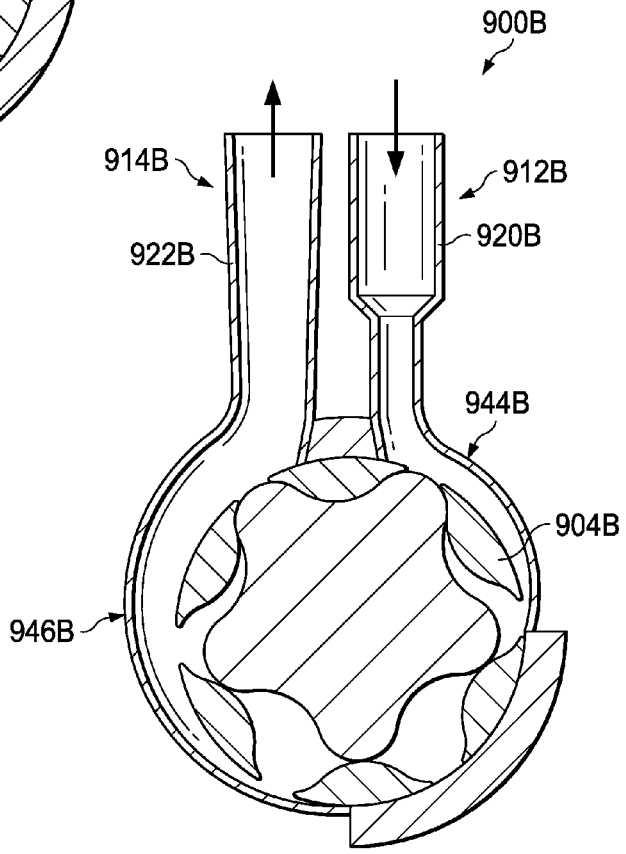
Figure 10A:
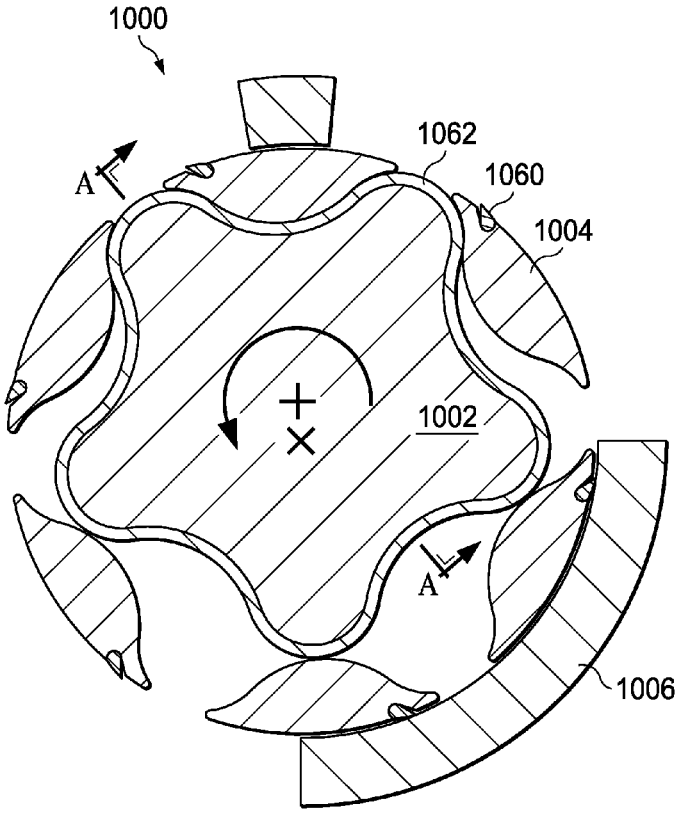
FIGS. 10A-10D show a gerotor system (FIG. 10A) having cutting edges located on an inner rotor (FIG. 10D) and an outer rotor (FIGS. 10B AND 10C) according to the disclosure.
Figure 10C:
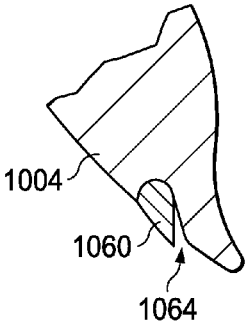
Figure 10B:
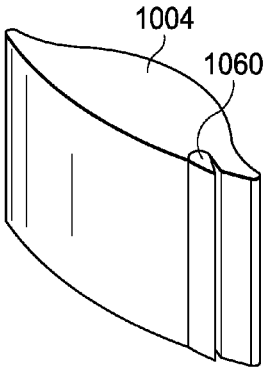
Figure 10D:
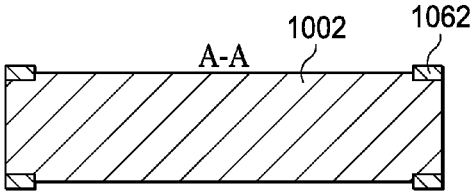

FIGS. 9A and 9B show inlet ducts according to the disclosure in which a converging section pre-accelerates fluid velocity in an inlet duct to match a velocity in a circumferential duct. FIG. 9A depicts a gerotor compressor 900A having an inlet duct 912A and an outlet duct 914A. A converging section 920A pre-accelerates fluid flow in the inlet duct 912A from a lower incoming velocity to a higher velocity entering a circumferential portion 944A of the inlet duct 912A. Similarly, a diverging section 922A decelerates fluid flow leaving a circumferential portion 946A of the outlet duct 914A to a desired discharge velocity.

FIG. 9B depicts a gerotor expander 900B having an inlet duct 912B and an outlet duct 914B. A converging section 920B pre-accelerates fluid flow in the inlet duct 912B from a lower incoming velocity to a higher velocity entering a circumferential portion 944B of the inlet duct 912B. Similarly, a diverging section 922B decelerates fluid flow leaving a circumferential portion 946B of the outlet duct 914B to a desired discharge velocity.

Inlet ducts 912A and 912B in this embodiment have rapidly converging profiles, while outlet ducts 914A and 914B have gradually diverging (e.g., conical) profiles. In other embodiments, an inlet duct may have a gradually converging profile and/or an outlet duct may have a rapidly diverging profile. To prevent flow separation, an angle less than about 7 degrees is preferred in such converging and diverging profiles.

Cut Abradable Coatings

To reduce leakage losses, a gerotor system should have small clearances between inner and outer rotors and the gerotor housing. During operation, the rotors are subjected to temperatures that cause the rotors to thermally expand. Should the rotors touch each other or the housing, damage can occur to the rotors and/or the housing.

To avoid damage when such contact occurs, it is desirable for one contacting element to have a hard surface, while the other contacting element has an abradable coating, such as molybdenum disulfide, polymers (e.g., porous epoxy), or soft metal (e.g., babbitt, brass, or copper). A particularly effective coating is nickel/graphite, which is applied via thermal spray. The nickel is porous with graphite-filled voids. If there is a large interference, the hard surface contacts the nickel/graphite coating and causes a portion of the coating to be removed. If there is a small interference, the hard surface contacts the nickel/graphite coating and pushes the nickel into the voids, thus displacing graphite.

When there is contact between the hard surface and the abradable coating, it is preferred that the hard surface be rough, such as can be obtained via sand blasting. The roughened surface accomplishes two objectives: (1) it acts like sand paper and helps remove the abradable coating, and (2) the resulting gap is roughened, which causes turbulence and thereby reduces flow through the gap.

The roughened surface works particularly well with softer coatings; however, with harder coatings (e.g., nickel/graphite), galling can occur. To avoid galling, the hard surface may incorporate cutting edges. Such cutting edges may include roughened edges, configured to leave the abradable coating roughened.

FIG. 10 shows cutting edges located on an inner rotor and an outer rotor according to the disclosure. A gerotor system 1000 includes an inner rotor 1002, an outer rotor 1004, and a housing 1006. As may be seen in FIG. 10D, the inner rotor 1002 includes cutting edges 1062 on upper and lower edges of the inner rotor 1002, forming cutting edges on an top surface, a bottom surface, and an outer surface of the inner rotor 1002. As may be seen in FIGS. 10B and 10C, the outer rotor 1004 includes cutting edges 1060 on an outer surface of each lobe of the outer rotor 1004. The cutting edges 1060 and 1062 may be formed from Stellite or other very hard metal.

The cutting edges 1062 on the inner rotor 1002 may come into contact with mating surfaces on the outer rotor 1004 and/or the housing 1006. The mating surfaces have an abradable coating, as discussed above. The cutting edges 1062 are raised sufficiently high (preferably about 0.002 inch) from the upper and lower surfaces of the inner rotor 1002 that debris from the abradable coatings can be discharged, but not so high that significant dead volume is created between the inner rotor 1002 and the housing 1006.

The cutting edges 1060 on the outer rotor 1004 are located on the edges of the lobes. The mating surface of the housing 1006 has an abradable coating, as discussed above. The cutting edges are raised sufficiently high (preferably about 0.002 inch) from the surface of the outer rotor 1004 that debris from the abradable coatings can be discharged, but not so high that significant dead volume is created between the outer rotor 1004 and the housing 1006. A rake angle of the cutting edges 1060 is adjusted so that the cutting edge 1060 cuts the abradable coating, rather than smearing it, thereby reducing or preventing galling. Also, an open pocket 1064 is formed in the outer rotor 1004 in front of the cutting edge 1060, to collect debris generated from the abradable coating, which also reduces or prevents galling.

Reduce Deflection of Outer Rotor Lobes

The lobes of the outer rotor of a gerotor system bridge two discs that define the axial ends of the outer rotor. As the outer rotor spins, centrifugal forces act to deform it. Because the two discs are well supported in the radial direction, they do not undergo much deformation from centrifugal forces. In contrast, the lobes are not well supported in the radial direction and can deform significantly from centrifugal forces, particularly if the lobes bridge a long distance between the two discs.

If the disc and lobe are made from a single piece of material, then there are significant stress concentrations at the root of the lobe (the interface between the disc and lobe) as centrifugal forces are applied. If not addressed, such stress concentrations may cause cracks to form in the lobes of the outer rotor, which may lead to catastrophic failure. The chances of such failure can be reduced or eliminated by lowering the rotation rate of the outer rotor, however this solution may adversely affect compressor capacity.

To address stresses in the roots of the lobes of the outer rotor, a number of strategies may be deployed, as described below.

Figure 11A:
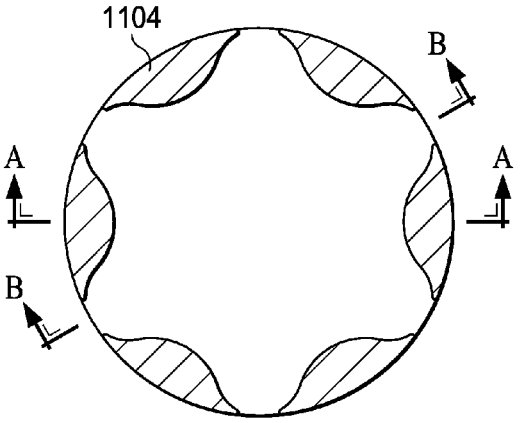
FIGS. 11A-11E show an outer rotor having fillets according to the disclosure (FIG. 11A), first and second sections through the outer rotor (FIGS. 11B and 11C), an inner rotor for use with the outer rotor (FIG. 11D), and a section through the inner rotor (FIG. 11E)
Figure 11B:
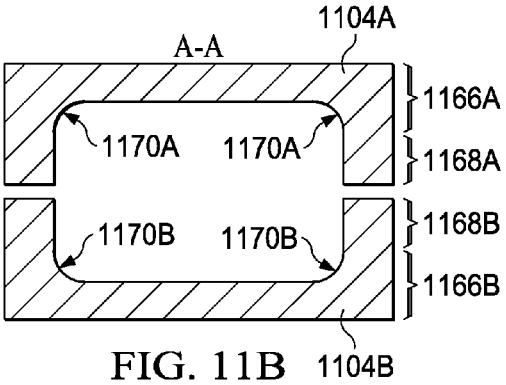
Figure 11C:
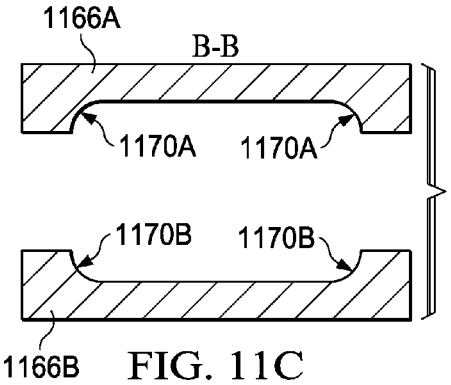

FIG. 11A shows an outer rotor 1104 according to the disclosure. The outer rotor 1104 demonstrates a first strategy to reduce stresses in the roots of the lobes of the outer rotor 1104. FIG. 11B is a first section through the outer rotor 1104, along line A-A. FIG. 11C is a second section through the outer rotor 1104, along line B-B. The outer rotor 1104 has fillets 1170, which are features on an inner surface of the outer rotor 1104 that reduce stress concentrations at the roots—or bases—of lobes 1168 in the outer rotor 1104.

The outer rotor 1104 comprises components 1104A and 1104B that are joined like a "clam shell." The component 1104A comprises disk/shoulder portion 1166A, fillet 1170A, and lobe portion 1168A. The component 1104B comprises disk/shoulder portion 1166B, fillet 1170B, and lobe portion 1168B. While components 1104A and 1104B are shown in FIG. 11B as separated by a gap, it will be understood that in operation, components 1104A and 1104B are mechanically coupled to each other to form a contiguous rotor. While the outer rotor 1104 is shown in FIGS. 11B and 11C as comprising two components, it will be understood that in other embodiments the outer rotor 1104 may be fabricated as a single component or from three or more components.

Figure 11E:
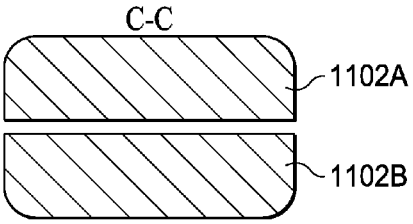
Figure 11D:
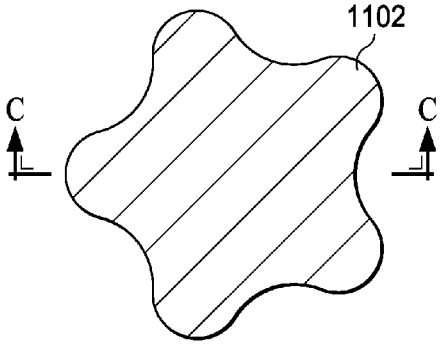

FIG. 11D depicts an inner rotor 1102 for use with the outer rotor 1104. The inner rotor 1102 is placed in an interior formed by joining components 1104A and 1104B. FIG. 11E presents a section through the inner rotor 1102 along the line C-C. The inner rotor 1102 comprises components 1102A and 1102B. While components 1102A and 1102B are shown in FIG. 11E as separated by a gap, it will be understood that in operation, components 1102A and 1102B are mechanically coupled to each other to form a contiguous rotor. While the inner rotor 1102 is shown in FIG. 11E as comprising two components, it will be understood that in other embodiments the inner rotor 1102 may be fabricated as a single component or from three or more components.

As may be seen in FIG. 11E, the upper and lower edges of the inner rotor 1102 are rounded to match a profile of the fillets 1170A and 1170B of the outer rotor 1104. Were the outer rotor 1104 to be entirely flat in the port regions (as outer rotor 1204 is, shown in FIG. 12C), the rounded edges of the inner rotor 1102 might introduce dead volume near the ports, which could adversely affect efficiency.

To reduce or eliminate this effect, the fillets continue to the port region, as shown in View B. Components 1102A and 1102B are fabricated with the shoulder portions 1166A and 1166B in the port regions. The shoulder portions 1166A and 1166B continue the fillets 1170A and 1170B into the port regions of the outer rotor 1104, to mate with the rounded upper and lower edges of the inner rotor 1102, in order to reduce dead volume near the ports and improver the efficiency of a gerotor system utilizing the outer rotor 1104 and the inner rotor 1102.

Figure 12A:
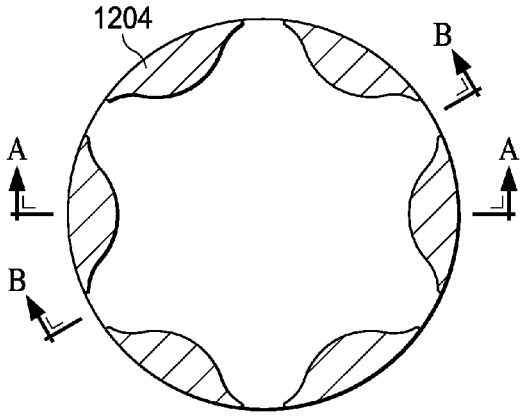
FIGS. 12A-12E show undercuts in an outer rotor according to the disclosure (FIG. 12A), first and second sections through the outer rotor (FIGS. 12B and 12C), an inner rotor for use with the outer rotor (FIG. 12D), and a section through the inner rotor (FIG. 12E)
Figure 12B:
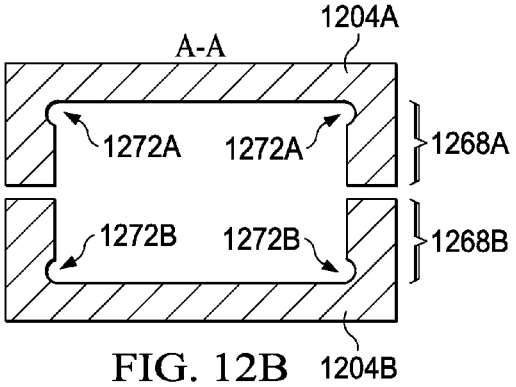
Figure 12C:
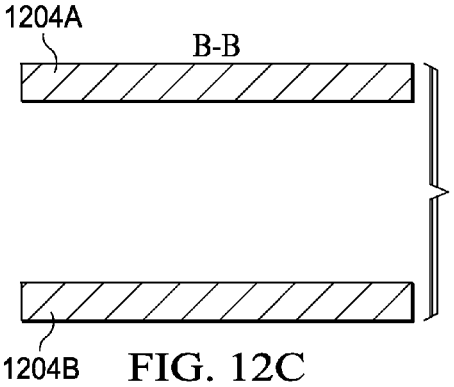

FIG. 12A shows an outer rotor 1204 according to the disclosure. The outer rotor 1204 demonstrates a second strategy to reduce stresses in the roots of the lobes of the outer rotor 1204. FIG. 12B is a first section through the outer rotor 1204, along line A-A. FIG. 12C is a second section through the outer rotor 1204, along line B-B. The outer rotor 2104 has undercuts 1272, which are features on an inner surface of the outer rotor 1204 configured to reduce stress concentrations at the roots of lobes 1268 in the outer rotor 1204. As may be seen in FIG. 12C, the outer rotor 1204 is flat in its port regions.

The outer rotor 1204 comprises components 1204A and 1204B that are mechanically coupled to each other to form the contiguous outer rotor 1204. The component 1204A comprises undercut 1272A and lobe portion 1268A. The component 1204B comprises undercut 1272A and lobe portion 1268A. While the outer rotor 1204 is shown in FIGS. 12B and 12C as comprising two components, it will be understood that in other embodiments the outer rotor 1204 may be fabricated as a single component or from three or more components.

Figure 12E:
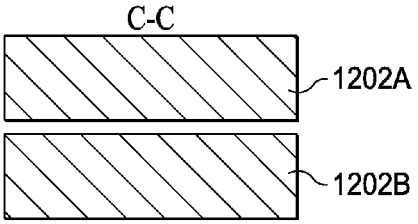
Figure 12D:
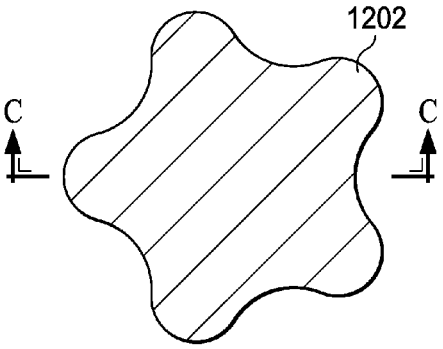

FIG. 12D depicts an inner rotor 1202 for use with the outer rotor 1204. FIG. 12E presents a section through the inner rotor 1202 along the line C-C. The inner rotor 1202 comprises components 1202A and 1202B, which are mechanically coupled to each other to form the inner rotor 1202. While the inner rotor 1202 is shown in FIG. 12E as comprising two components, it will be understood that in other embodiments the inner rotor 1202 may be fabricated as a single component or from three or more components.

Figure 13A:
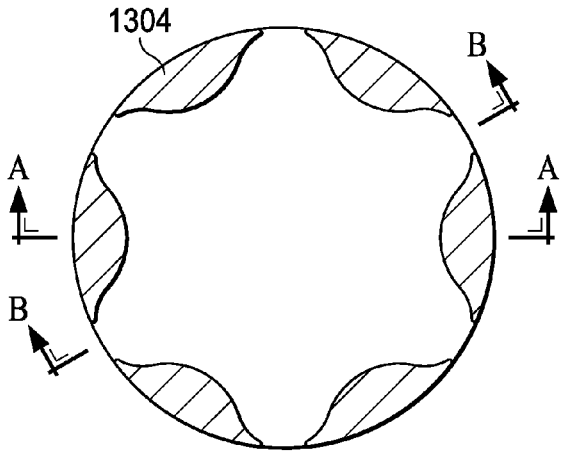
FIGS. 13A-13C show an outer rotor (FIG. 13A) and first and second sections through the outer rotor (FIGS. 13B and 13C) according to the disclosure, where lobes in an outer rotor are separate components from two discs that define axial ends of the outer rotor.
Figure 13B:
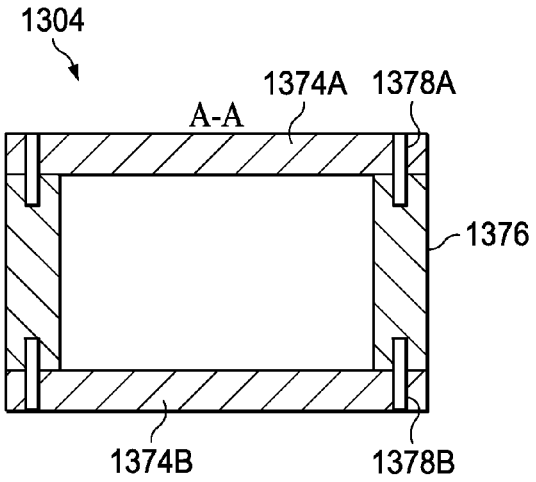
Figure 13C:
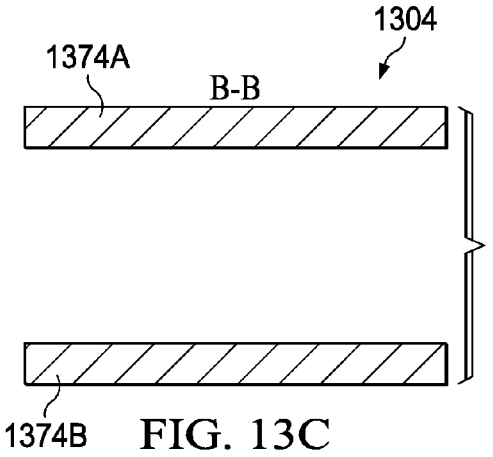

FIGS. 13A-13C show an outer rotor 1304 comprising disks 1374A and 1374B and lobes 1376. The lobes 1376 are joined to the disks 1374A and 1374B by pins 1378A and 1378B, respectively. FIG. 13B is a first section through the outer rotor 1304, along line A-A. FIG. 13C is a second section through the outer rotor 1304, along line B-B. As may be seen in FIG. 13C, the outer rotor 1304 is flat in its port regions.

The outer rotor 1304 eliminates stresses in its lobes by forming the lobes 1376 as separate components from the disks 1374A and 1374B. Instead, because of centrifugal forces on the lobes 1376, the pins 1378A and 1378B are subjected to shear forces. To reduce centrifugal forces, the lobes 1376 may be constructed from lightweight materials, such as titanium whereas the discs 1374A and 1374B may be made from less expensive materials, such as steel. In a preferred embodiment, the lobes 1376 are constructed from materials that are both lightweight and stiff, such as carbon fiber composites or silicon carbide. To reduce the impact of centrifugal forces on the lobes of the outer rotor, the material property of interest for the lobes is the specific modulus, also known as the stiffness to weight ratio or specific stiffness.

Figure 14A:
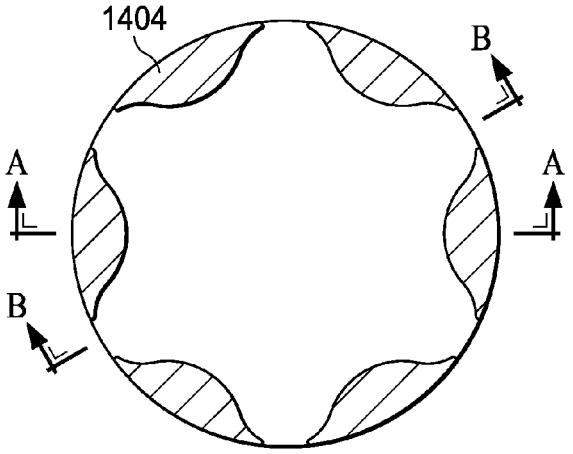
FIGS. 14A-14C show another outer rotor (FIG. 14A) and first and second sections through the outer rotor (FIGS. 14B and 14C) according to the disclosure, where lobes of the outer rotor are secured with bolts that bridge the discs.
Figure 14B:
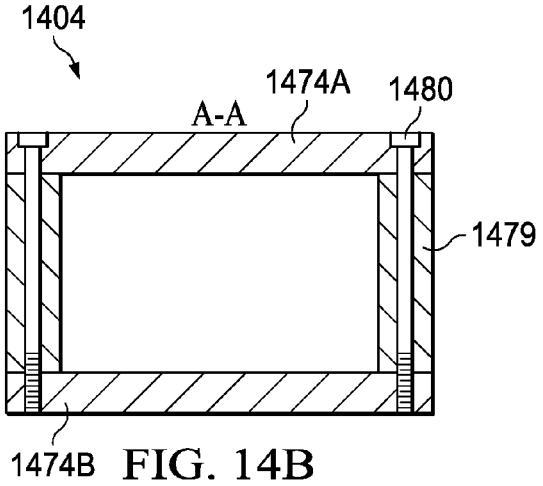
Figure 14C:
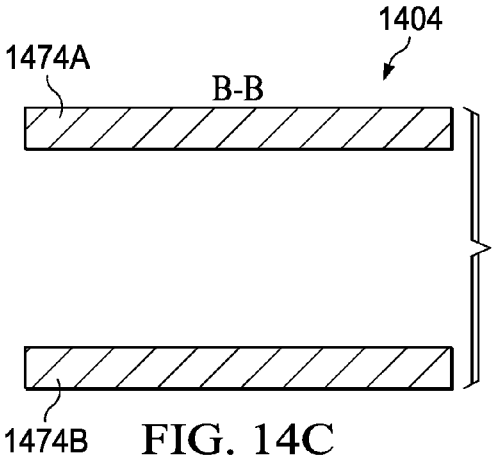

FIGS. 14A-14C show an outer rotor 1404 comprising disks 1474A and 1474B and lobes 1479. The lobes 1479 are joined to the disks 1474A and 1474B by bolts 1480. FIG. 14B is a first section through the outer rotor 1404, along line A-A. FIG. 14C is a second section through the outer rotor 1404, along line B-B. As may be seen in FIG. 14C, the outer rotor 1404 is flat in its port regions.

The bolts 1480 pass completely through the disk 1474A, the lobe 1479, and the disk 1474B. As described for outer rotor 1304, shown in FIG. 13, the outer rotor 1404 eliminates stresses in its lobes by forming the lobes 1479 as separate components from the disks 1474A and 1474B, subjecting the bolts 1480 to shear forces due to centrifugal forces on the lobes 1479. Additionally, friction between mating surfaces of the lobes 1479 and the disks 1474A and 1474B, created by clamping forces from the bolts 1480, reduces shear forces on the bolts 1480 and helps secure the lobes 1479 in place. A pin (not shown) can be used in addition to the bolts 1480 to ensure that the lobes 1479 are properly located on the discs 1474A and 1474B. Elements of alternative embodiments as described with reference to FIGS. 13A-13C may also be used with the embodiment shown in FIGS. 14A-14C.

Figure 15A:
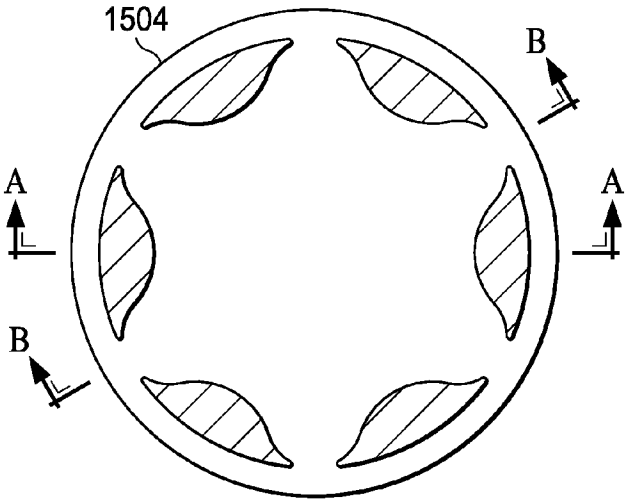
FIGS. 15A-15D show yet another outer rotor (FIG. 15A), first and second sections of the outer rotor (FIGS. 15B and 15C), and a section through an alternative embodiment of the outer rotor (FIG. 15D) according to the disclosure where lobes of the outer rotor fit into pockets on the discs.
Figure 15C:
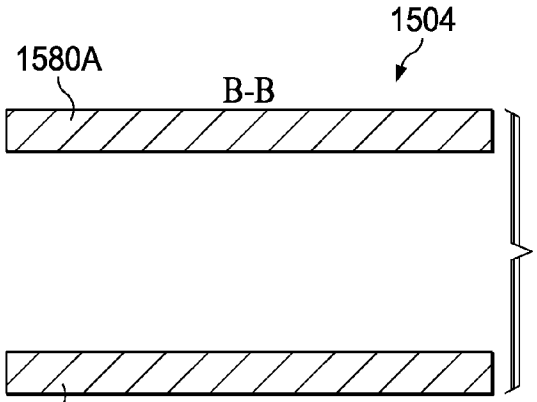
Figure 15B:
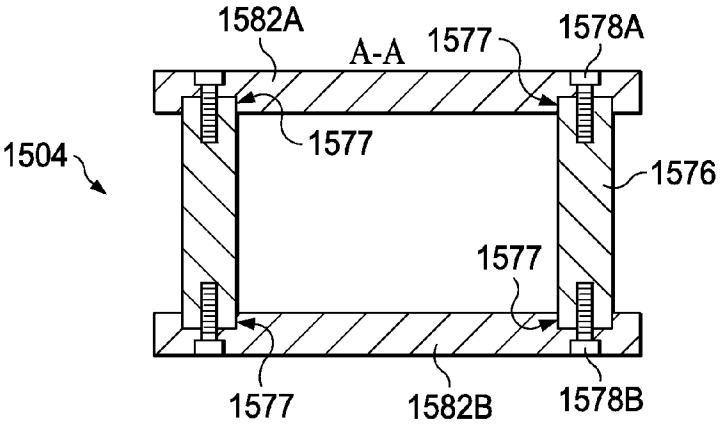
Figure 15D:
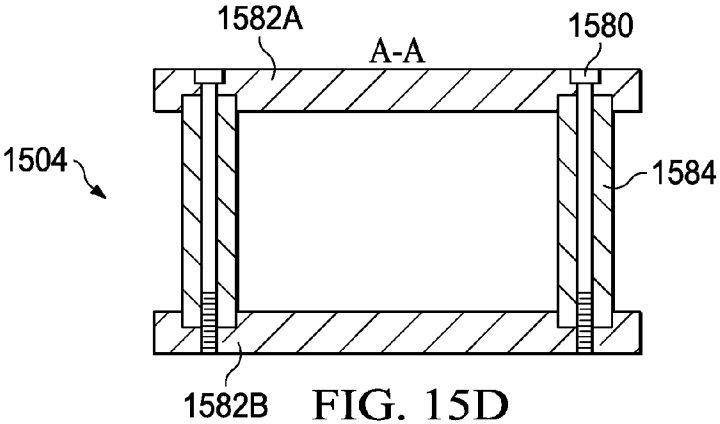

FIGS. 15A-15D show an outer rotor 1504 comprising disks 1582A and 1582B and lobes 1576 (in FIG. 15B) and lobes 1584 (in FIG. 15D). FIG. 15B is a section through the outer rotor 1504, along line A-A, and shows the lobes 1576 joined to the disks 1582A and 1582B by short bolts 1578. FIG. 15C is a section through the outer rotor 1504, along line B-B. As may be seen in FIG. 15C, the outer rotor 1504 is flat in its port regions. FIG. 15D is a section through the outer rotor 1504, along line A-A, and shows the lobes 1584 joined to the disks 1582A and 1582B by through-bolts 1580.

The lobes 1576 and 1584 fit into pockets or recesses 1577 in the disks 1574A and 1574B. This design reduces stress on the bolts 1578 and 1580 by allowing some of the centrifugal force experienced by the lobes 1576 and 1584 to be resisted by forces on the sidewalls of the pockets 1577, in addition to forces on the bolts 1578 and 1580. Benefits and suitable elements of alternative embodiments as described with reference to FIGS. 13A-13C and 14A-14C may also be used with the embodiment shown in FIGS. 15A-15D.

Figure 16B:
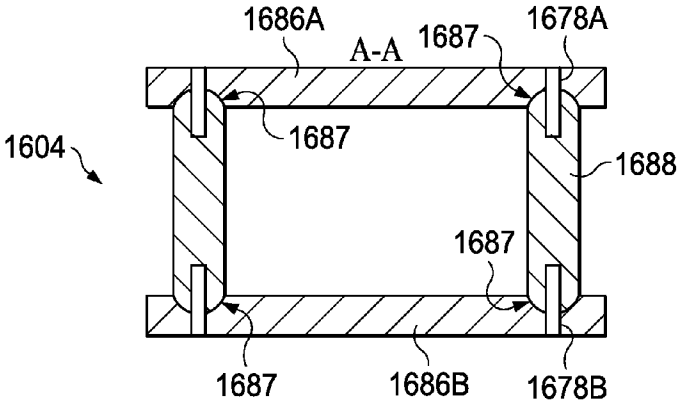
FIGS. 16A-16D shows still another outer rotor (FIG. 16A), first and second sections of the outer rotor (FIGS. 16B and 16C), and a section through an alternative embodiment of the outer rotor (FIG. 16D) according to the disclosure where lobes of the outer rotor fit into rounded pockets on the discs.
Figure 16D:
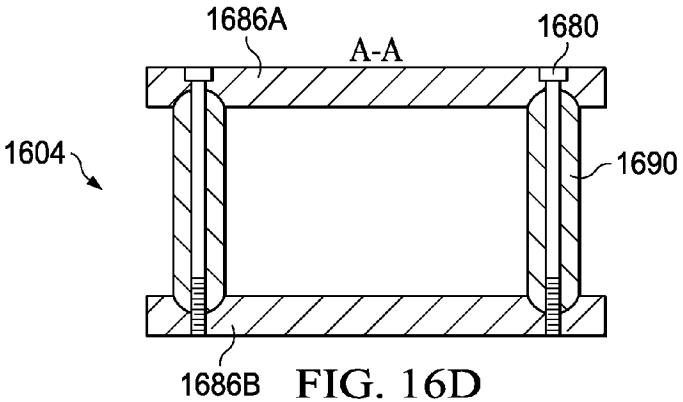
Figure 16A:
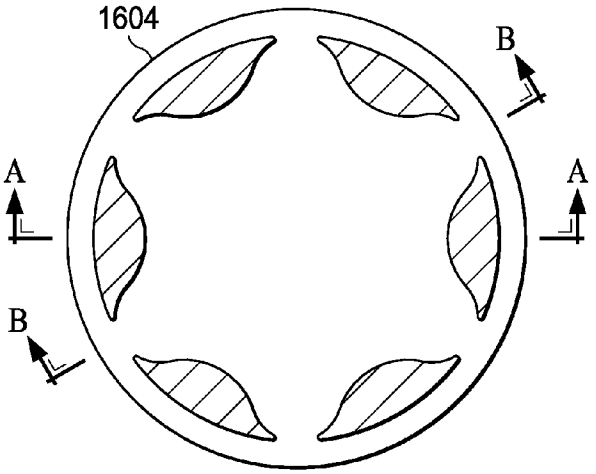
Figure 16C:
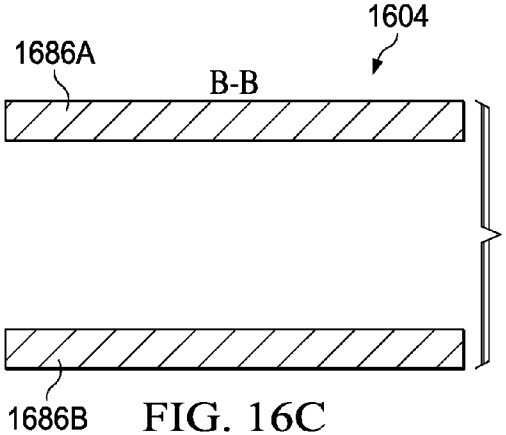

FIGS. 16A-16D show an outer rotor 1604 comprising disks 1686A and 1686B and lobes 1688 (in FIG. 16B) and lobes 1690 (in FIG. 16D). FIG. 16B is a section through the outer rotor 1604, along line A-A, and shows the lobes 1688 joined to the disks 1686A and 1686B by short bolts 1678A and 1678B. FIG. 16C is a section through the outer rotor 1604, along line B-B. As may be seen in FIG. 16C, the outer rotor 1604 is flat in its port regions. FIG. 16D is a section through the outer rotor 1604, along line A-A, and shows the lobes 1690 joined to the disks 1686A and 1686B by through-bolts 1680.

The lobes 1688 and 1690 are rounded and fit into rounded pockets or recesses 1687 in the disks 1686A and 1686B. A rounding profile of the recesses 1687 corresponds to a rounding profile of the lobes 1688 and 1690. As with the outer rotor 1504 described with reference to FIGS. 15A-15D, the design of outer rotor 1604 reduces stress on the bolts 1678 and 1680 by allowing some of the centrifugal force experienced by the lobes 1688 and 1690 to be resisted by forces on the sidewalls of the pockets 1687, in addition to forces on the bolts 1678 and 1680. Additionally, this design element of outer rotor 1604 further reduces stresses on elements of the outer rotor 1604 by allowing the lobes 1688 and 1690 to rotate within the recesses 1687 when the center portions of the lobes 1688 and 1690 bow out relative to the end portions, due to centrifugal forces on the lobes 1688 and 1690. Benefits and suitable elements of alternative embodiments as described with reference to FIGS. 13A-13C, 14A-14C, and 15A-15D may also be used with the embodiment shown in FIGS. 16A-16D.

Figure 17:
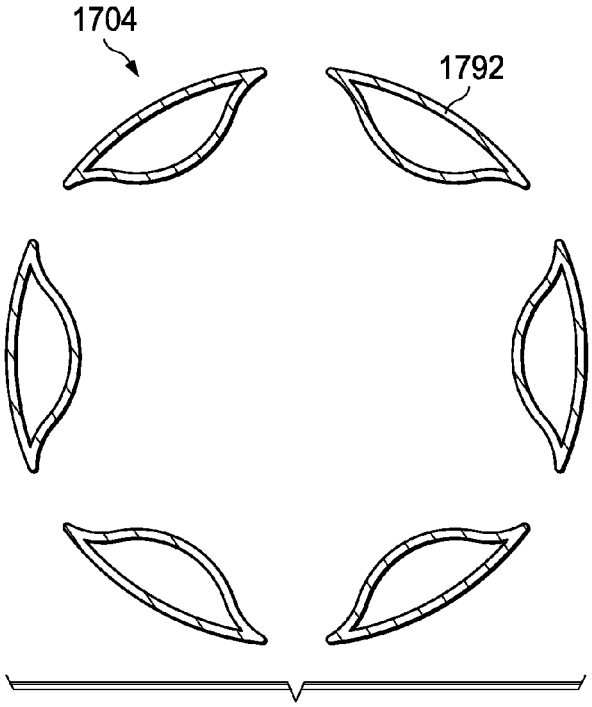
FIG. 17 shows a cross-section view through hollow lobes of an outer rotor according to the disclosure.

FIG. 17 shows a cross-section view through hollow lobes 1792 of an outer rotor 1704 according to the disclosure. Fabricating a lobe of an outer rotor as a hollow element reduces the mass of the lobe and thereby its deflection from centrifugal force, while maintaining the strength of the lobe. The hollow lobes 1792 may be used with any of the outer rotor embodiments having separate disk and lobe elements, as were described with reference to FIGS. 13A-13C, 14A-14C, 15A-15D, and 16A-16D.

Figure 18:
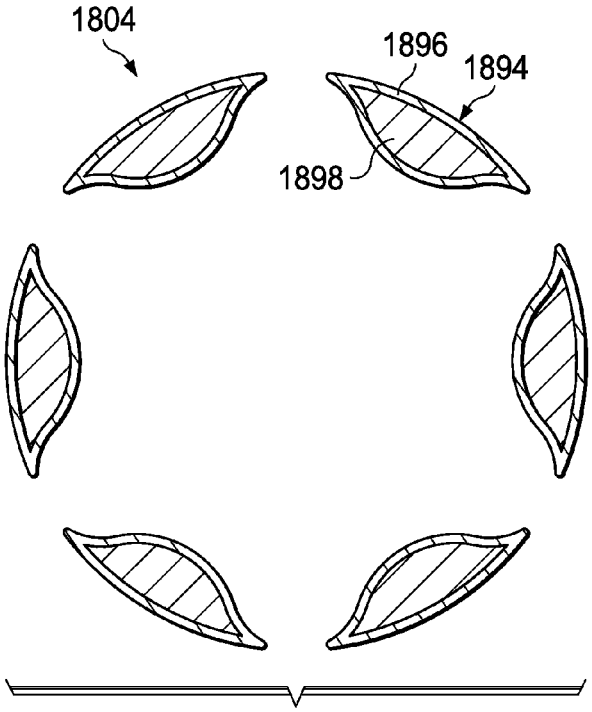
FIG. 18 shows a cross-section view through lobes of an outer rotor according to the disclosure wherein an outer portion of the lobes comprises a first material and an inner portion of the lobes comprises a second material.

FIG. 18 shows a cross-section view through lobes 1894 of an outer rotor 1804 according to the disclosure wherein an outer portion of the lobes comprises a first material 1896 and an inner portion of the lobes comprises a second material 1898. The second material 1898 may be a foamed metal, which reduces weight while supplying stiffness. In other embodiments, the second material 1898 may be a material that is light and stiff, such as carbon fiber composite or ceramic. The filled lobes 1894 may be used with any of the outer rotor embodiments having separate disk and lobe elements, as were described with reference to FIGS. 13A-13C, 14A-14C, 15A-15D, and 16A-16D.

Reduce Leakage Through Tight Gaps

Figure 19A:
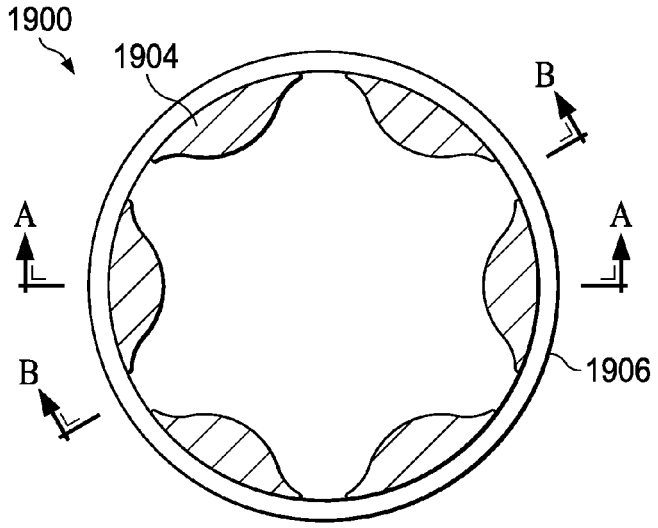
FIGS. 19A-19C and 20A-20C show gerotor systems (FIGS. 19A and 20A) having labyrinth seals according to the disclosure on a circumference of an outer rotor (FIGS. 19B and 19C) and a housing (FIGS. 20B and 20C)
Figure 19B:
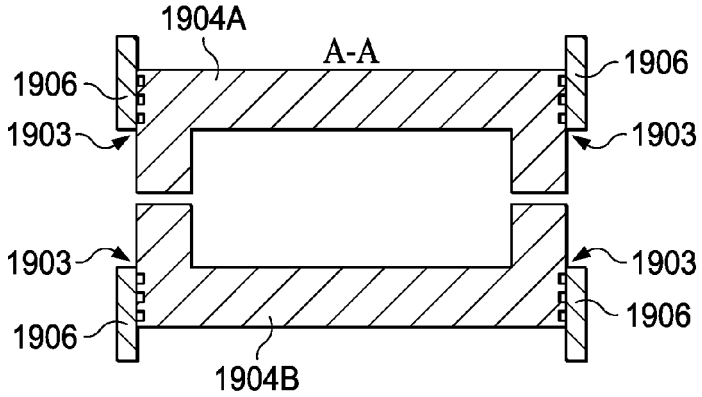
Figure 19C:
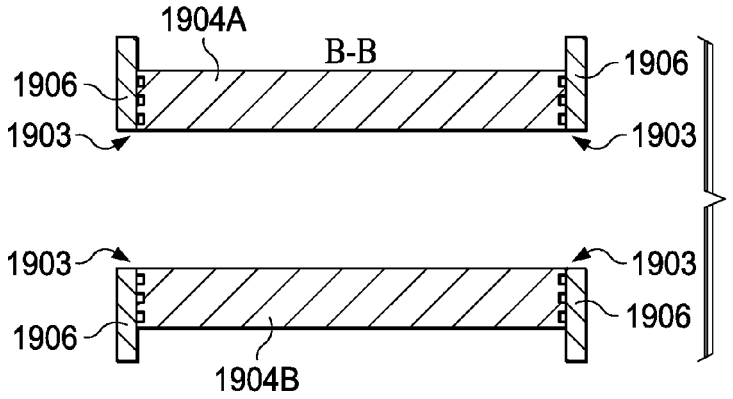

FIGS. 19A-19C show labyrinth seals according to the disclosure on a circumference of an outer rotor. As may be seen in FIG. 19A, a gerotor system 1900 according to the disclosure includes an outer rotor 1904 and a housing 1906. FIG. 19B is a first section through the outer rotor 1904 and housing 1906, along line A-A. FIG. 19C is a second section through the outer rotor 1904 and housing 1906, along line B-B.

As may be seen in FIG. 19B, the outer rotor 1904 comprises components 1904A and 1904B that are joined like a clam shell. The components 1904A and 1904B each has an outer surface region that is in proximity to a corresponding inner surface region of the housing 1906. These outer surface regions are fabricated with labyrinth seals 1903 that create a tortuous path to reduce fluid leakage through the gaps between the outer surface regions of the components 1904A and 1904B and the corresponding inner surface regions of the housing 1906. Exemplary labyrinth seals are discussed in greater detail with reference to FIG. 21.

Figure 20A:
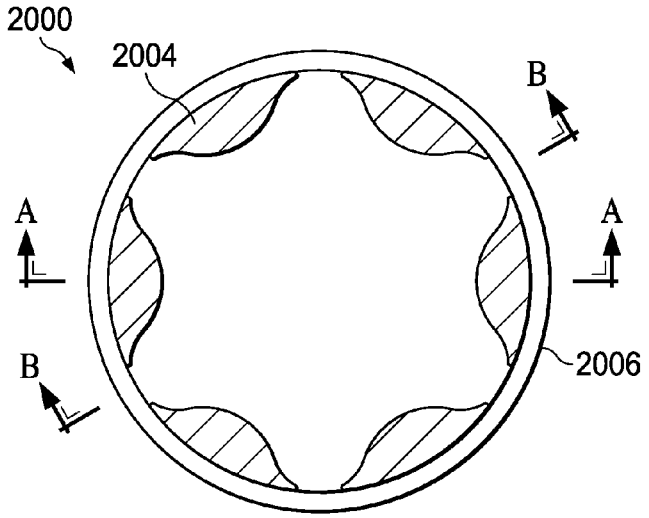
Figure 20B:
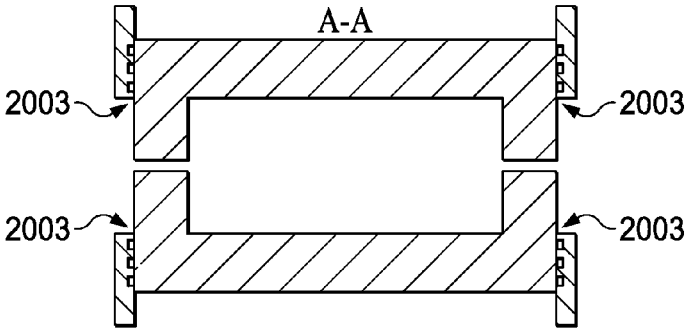
Figure 20C:
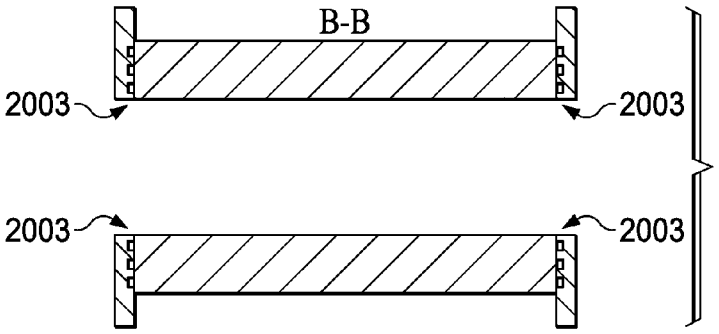

FIGS. 20A-20C show a gerotor system 2000 having a similar system of labyrinth seals 2003 between an outer rotor 2004 and a housing 2006. As may be seen in FIGS. 20B and 20C, the labyrinth seals 2003 are fabricated in inner surface regions of the housing 2006 that are in proximity to outer surface regions of the outer rotor 2004.

Figure 21:
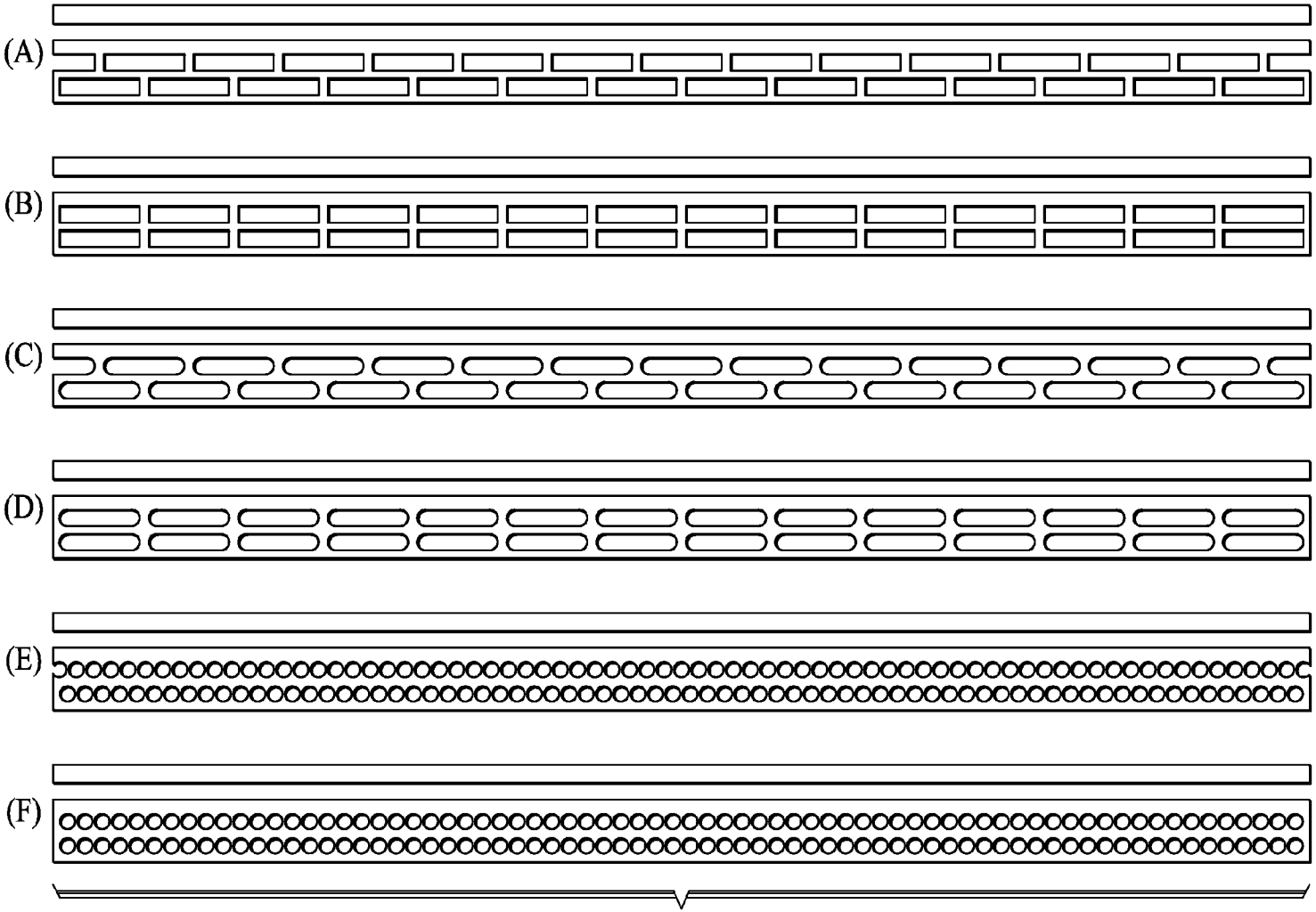
FIG. 21 shows exemplary labyrinth seals according to the disclosure.

FIG. 21 shows exemplary labyrinth seals according to the disclosure. As may be seen, many configurations are possible for labyrinth seals according to the disclosure. As depicted in FIG. 21, the upper side of the labyrinths seals are farthest from the outer rotor lobes, while the lower side of the labyrinth seals are closest to the outer rotor lobes. The slots closest to the outer rotor lobes are discontinuous, which prevents "short circuiting" of gas from high-pressure regions of the circumference to low-pressure regions.

In the embodiments shown in FIG. 21, the slot farthest from the lobes is continuous, which allows the pressure to equalize along the circumference. The pressure in this farthest slot is intermediate between inlet and outlet pressure of the compressor, but closer to the inlet pressure. For example, if the inlet pressure of the compressor is 20 psia and the outlet is 50 psia, the pressure in the furthest slot would be approximately 25 psia.

The outer faces of the outer rotor are coupled to bearings and gears, all of which are lubricated with oil that ultimately drains to a sump. Typically, the pressure in the oil sump is referenced to the compressor inlet (20 psia in this example), which is the lowest continuous pressure in the system. This strategy ensures that oil flows from the bearings and gears back to the sump. Temporarily, while a given void space is expanding and drawing gas into it, the pressure in the void space will drop below the compressor inlet pressure (for example 18 psia). During this temporary suction event, the void space could draw oil through the gaps into the void space. Generally, there is a desire to prevent the gas from being contaminated with oil, so this is an undesirable outcome. By ensuring that the farthest slot always has a slight pressure above the sump pressure, it ensures that gas leakage is always outward from the compression space and therefore oil cannot enter the compression space.

Figure 22A:
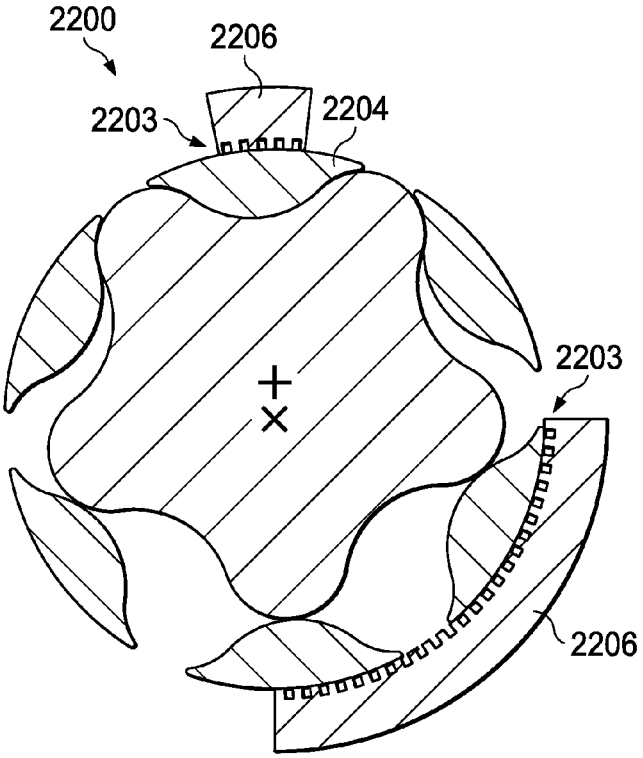
FIGS. 22A and 22B show gerotor systems having exemplary labyrinth seals according to the disclosure on a housing (FIG. 22A) and on an outer rotor (FIG. 22B)
Figure 22B:
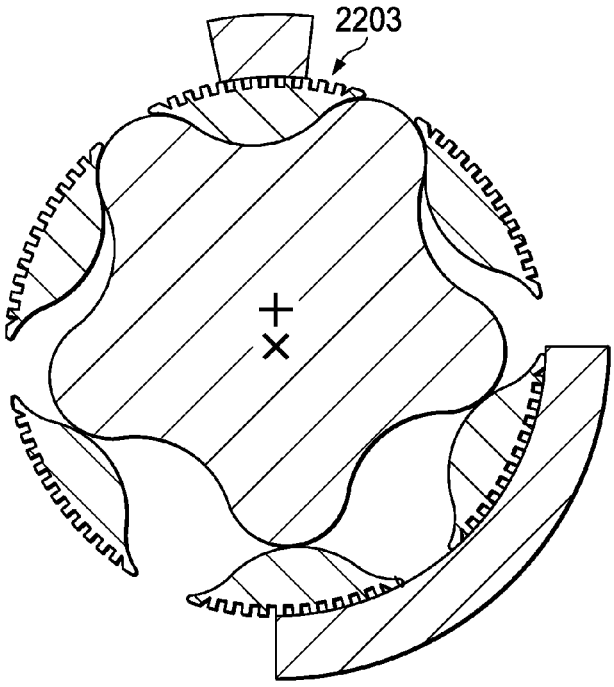

FIGS. 22A and 22B show top views of a gerotor system 2200 including an outer rotor 2204 and a housing 2206. The gerotor system 2200 has labyrinth seals 2203 in the circumferential gaps between the housing and lobes of the outer rotor. In FIG. 24A, the labyrinth seals 2203 are fabricated in a region of an inner surface of the housing 2206 in proximity to a region of an outer surface of the outer rotor 2204. In FIG. 22B, the labyrinth seals 2203 are fabricated in a region of an outer surface of the outer rotor 2204 that is in proximity to a region of an inner surface of the housing 2206. The slots 2203 can be continuous or discontinuous in the axial direction.

Figure 23:
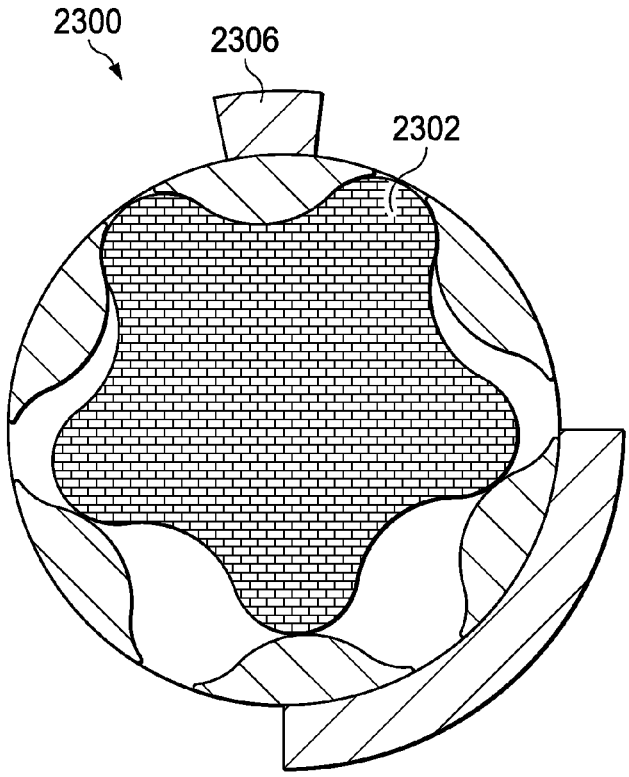
FIG. 23 shows labyrinth seals according to the disclosure on a face of an inner rotor.

FIG. 23 shows a gerotor system 2300 that includes an inner rotor 2302 and a housing 2306. The inner rotor 2302 includes labyrinth seals on an upper face and a lower face (not shown) of the inner rotor 2302. The labyrinth seals of FIG. 23 reduce fluid leakage along gaps between the faces of the inner rotor 2302 and inner faces of portions (not shown) of the housing 2306. In FIG. 23, the labyrinth seal is represented as shallow rectangular depressions in a staggered, brick-like pattern. Other patterns are possible, for example, arrays of hexagons and circles or discontinuous slots.

While the labyrinth seal is shown in FIG. 23 on the face of the inner rotor, it will be understood that in other embodiments the labyrinth seal may be on the inner face of the housing.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke paragraph 6 of 35 U.S.C. Section 112 as it exists on the date of filing hereof unless the words "means for" or "step for" are explicitly used in the particular claim.

What is claimed is:

1. A gerotor system comprising an inner rotor, an outer rotor having a plurality of lobes, and a housing, the outer rotor including an outer circumferential surface having a region in proximity to a corresponding region of an inner surface of the housing, one of the outer rotor region and the housing region comprising a labyrinth seal configured to reduce fluid leakage through a gap between the outer rotor region and the housing region, wherein the labyrinth seal includes first and second portions, the first portion located farther from the plurality of lobes than the second portion, wherein the first portion includes at least one slot that is continuous and the second portion includes at least one slot that is discontinuous.

2. The gerotor system of claim 1, wherein the labyrinth seal is configured to maintain a pressure in the continuous slot that is intermediate between an inlet pressure and an outlet pressure of the gerotor system.

3. The gerotor system of claim 1, the outer rotor including a plurality of lobe portions and at least one disk portion, wherein the outer rotor region is located on one of the plurality of lobe portions and the at least one disk portion.

* * * * *